US010902819B2

(12) United States Patent
Kimura et al.

(10) Patent No.: US 10,902,819 B2
(45) Date of Patent: Jan. 26, 2021

(54) CONNECTION DEVICE, DISPLAY DEVICE, AND CONTROL METHOD FOR THE DISPLAY DEVICE

(71) Applicant: SEIKO EPSON CORPORATION, Tokyo (JP)

(72) Inventors: Fusashi Kimura, Matsumoto (JP); Kazuma Sakata, Matsumoto (JP); Kazuma Kitadani, Chino (JP); Yuichi Kunitomo, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/403,684

(22) Filed: May 6, 2019

(65) Prior Publication Data

US 2019/0340999 A1 Nov. 7, 2019

(30) Foreign Application Priority Data

May 7, 2018 (JP) ..... 2018-089188

(51) Int. Cl.
*G09G 5/00* (2006.01)

(52) U.S. Cl.
CPC ..... *G09G 5/006* (2013.01); *G09G 2320/08* (2013.01); *G09G 2330/023* (2013.01); *G09G 2330/026* (2013.01); *G09G 2354/00* (2013.01)

(58) Field of Classification Search
CPC ..... G06F 1/163–1633; G06F 1/1637; G06F 1/1647; G06F 1/3203; G06F 1/3206; G06F 1/3215; G06F 1/3218; G06F 1/3231; G06F 1/3262; G06F 1/3265; G06F 1/3287; G09G 5/003; G09G 5/006; G09G 2320/06; G09G 2320/0606; G09G 2320/08;

(Continued)

(56) References Cited

U.S. PATENT DOCUMENTS 6,438,708 B1 * 8/2002 Shinichi ..... G06F 1/1616 713/324
2006/0035527 A1 * 2/2006 Numano ..... G06F 1/266 439/668

(Continued)

FOREIGN PATENT DOCUMENTS

JP 2017-183826 A 10/2017
KR 20090106061 A * 10/2009

OTHER PUBLICATIONS

English translation of KR-20090106061-A (Year: 2009).*

*Primary Examiner* — Nathan Danielsen
(74) *Attorney, Agent, or Firm* — Oliff PLC

(57) ABSTRACT

A connection device to which a PC and a head-mounted image display unit that includes a right display unit and a left display unit configured to display an image are connected, the connection device including a control unit configured to control the right display unit and the left display unit to enable execution of functions including a display function of displaying an image input from the PC and a display stop function of stopping display, wherein the control unit activates the image display unit in a display mode based on a display condition when power supply to the connection device is started, and the display mode includes at least a first display mode in which the image is displayed on the right display unit and the left display unit and the display stop function is disabled.

8 Claims, 9 Drawing Sheets

(58) Field of Classification Search
CPC ..... G09G 2330/02; G09G 2330/021; G09G 2330/023; G09G 2330/026; G09G 2330/027; G09G 2354/00; G09G 2370/08; G09G 2370/22
See application file for complete search history.

(56) References Cited

U.S. PATENT DOCUMENTS

| | | | | |
|---|---|---|---|---|
| 2013/0019199 | A1* | 1/2013 | Ko | H04M 1/67 715/781 |
| 2016/0034251 | A1* | 2/2016 | Sendai | G06F 3/167 345/156 |
| 2017/0277221 | A1 | 9/2017 | Degawa et al. | |
| 2018/0210737 | A1* | 7/2018 | Feinberg | G06F 9/4418 |

* cited by examiner

CONNECTION DEVICE, DISPLAY DEVICE, AND CONTROL METHOD FOR THE DISPLAY DEVICE

The present application is based on, and claims priority from JP Application Serial Number 2018-089188, filed May, 7, 2018, the disclosure of which is hereby incorporated by reference herein in its entirety.

BACKGROUND

1. Technical Field

The present disclosure relates to a connection device, a display device, a control method for the connection device, and a control method for the display device.

2. Related Art

In related art, a device that connects a display device to an external device is known (for example, see JP-A-2017-183826). In the head-mounted display described in JP-A-2017-183826, functions of a head-mounted display such as telephone, voice input/output, display, touch operation, image adjustment, and the like are set according to cartridge data stored in a cartridge.

JP-A-2017-183826 discloses that a head-mounted display sets an on/off state of a function of the head-mounted display. However, there has been no proposal on a method of setting the operation itself regarding turning on/off the function of the display device.

SUMMARY

An advantage of the present disclosure is to make it possible to set a function for turning on/off a function of a display device.

To solve the problems described above, the present disclosure provides a connection device to which an information processing device and a display device that is head-mounted and that includes an image display unit are connected, the connection device including a control unit configured to control the image display unit to execute functions including a display function of displaying, on the image display unit, an image input from the information processing device and a display stop function of stopping display by the image display unit, and a storage unit configured to store display condition of the image display unit, wherein the control unit activates the display device in a display mode based on the display condition stored in the storage unit when power supply to the connection device is started, and the display mode includes at least a first display mode in which the image input from the information processing device is displayed on the image display unit by the display function and the display stop function is disabled.

Further, the present disclosure may be a configuration including an operating unit configured to receive an operation, wherein the control unit is configured to execute the display stop function based on the operation received by the operating unit and not to execute the display stop function regardless of the operation of the operating unit during execution of the first display mode.

Further, the present disclosure may be a configuration where the display mode includes a second display mode in which the control unit executes the display function to display, on the image display unit, the image input from the information processing device and executes the display stop function according to the operation of the operating unit.

Further, the present disclosure may be a configuration where the display mode includes a third display mode in which the control unit does not cause the image to be displayed on the image display unit and executes the display function according to the operation of the operating unit.

Further, the present disclosure may be a configuration including a first connection unit connected to the display device, a second connection configured to receive power supply, and a third connection unit connected to the information processing device to receive input of an image, wherein the control unit activates the display device in a display mode based on the display condition stored in the storage unit when power supply to the second connection unit is started.

Further, the present disclosure may be a configuration where the second connection unit is formed integrally with the third connection unit and receives power supply from the information processing device.

Further, to solve the problems described above, the present disclosure provides a display device that is head-mounted and that includes an image display unit, the display device including: a connection unit connected to an information processing device, a control unit configured to execute functions including a display function of displaying, on the image display unit, an image input from the information processing device and a display stop function of stopping display by the image display unit, and a storage unit configured to store a display condition of the image display unit, wherein the control unit performs activation in a display mode based on the display condition stored in the storage unit when power supply to the display device is started, and the display mode includes at least a first display mode in which the image input from the information processing device is displayed on the image display unit by the display function and the display stop function is disabled.

Further, to solve the problems described above, the present disclosure provides a control method for a connection device to which an information processing device and a display device that is head-mounted and that includes an image display unit are connected, the control method including, when controlling the image display unit to enable execution of functions including a display function of displaying, on the image display unit, an image input from the information processing device and a display stop function of stopping display by the image display unit, activating the display device in a display mode based on a display condition stored in a storage unit when power supply to the connection device is started, wherein the display mode includes at least a first display mode in which the image input from the information processing device is displayed on the image display unit by the display function and the display stop function is disabled.

Further, to solve the problems described above, the present disclosure provides a control method for a display device that includes an image display unit that is head-mounted and that is configured to display an image, and a connection unit connected to an information processing device, the display device being configured to execute functions including a display function of displaying, on the image display unit, an image input from the information processing device and a display stop function of stopping displaying of the image display unit, the control method including performing activation in a display mode based on a display condition stored in a storage unit when power supply to the display device is started, wherein the display mode includes at least a first display mode in which the image input from the information processing device is displayed on the image display unit by the display function and the display stop function is disabled.

The present disclosure can be realized in various embodiments other than the connection device, the display device, the control method for the connection device, and the control method for the display device described above. For example, it may be realized as a program for executing the above display method by a computer. Further, it can be realized in an embodiment of a recording medium in which the program is recorded, a server device for delivering the program, a transmission medium for transmitting the program, a data signal in which the program is embodied on a carrier wave, and the like.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

1. First Exemplary Embodiment

1-1. Configuration of Display System

Figure 1:
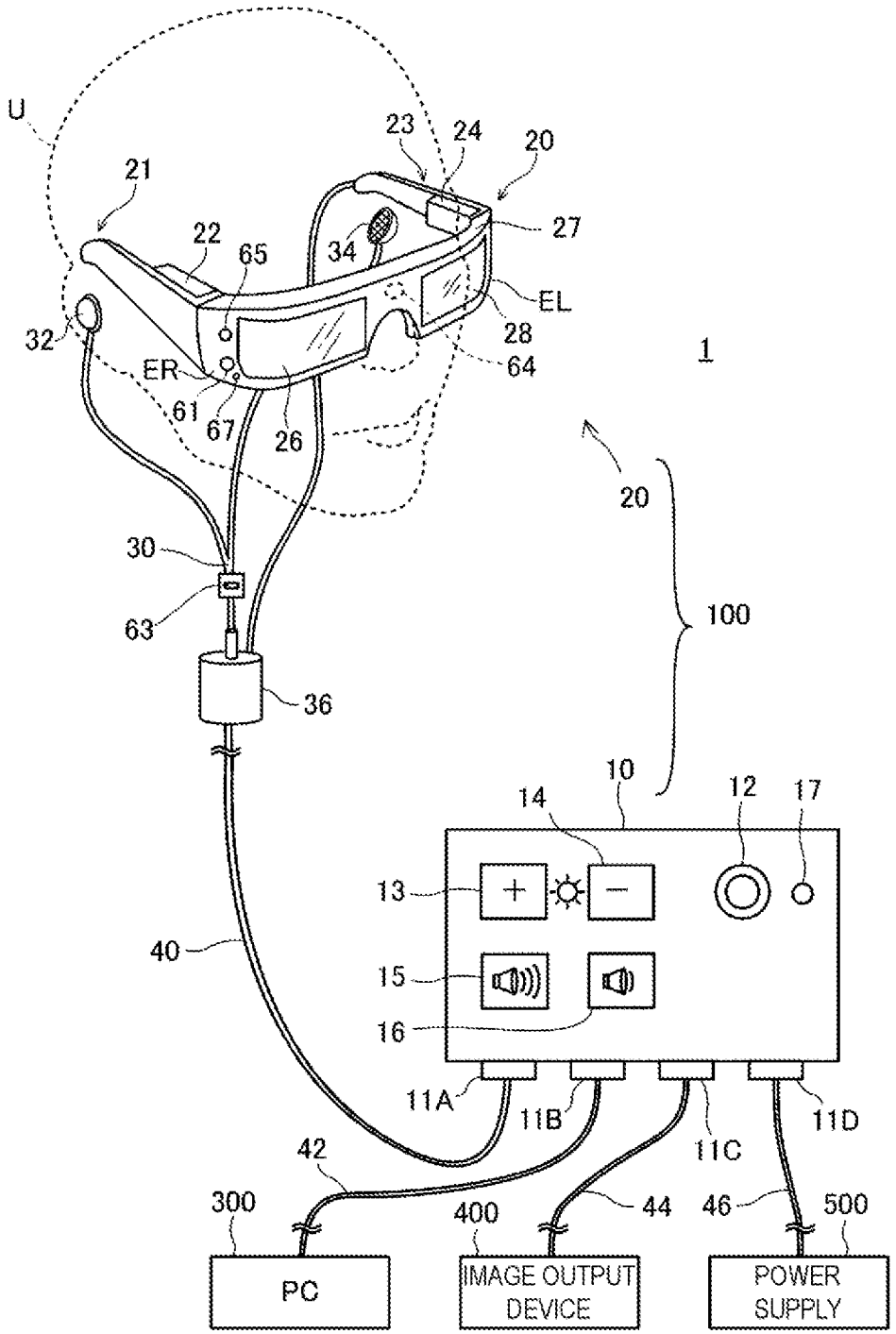
FIG. 1 is a diagram illustrating a schematic configuration of a display system according to First Exemplary Embodiment.

FIG. 1 is a diagram illustrating a schematic configuration of a display system 1 according to First Exemplary Embodiment to which the present disclosure is applied.

The display system 1 includes an HMD 100 which is a head-mounted display device. HMD is an abbreviation for Head Mounted Display. The HMD 100 includes an image display unit 20 mounted on a head of a user and a connection device 10 and causes the user to visually recognize a virtual image with the image display unit 20 in a state of being mounted on the head of the user. The image display unit 20 corresponds to a display device of the present disclosure. In the following description, the user refers to a user who wears and uses the HMD 100.

The connection device 10 includes connectors 11A, 11B, 11C, and 11D in a box-shaped case, and the image display unit 20 is connected to the connector 11A via a display unit connecting cable 40. Hereinafter, in a case where the connectors 11A, 11B, 11C, and 11D are not distinguished, the connectors 11A, 11B, 11C, and 11D will be referred to as connectors 11. The case of the connection device 10 can be referred to as a housing or a main body.

The display system 1 is a system configured by connecting an external device to the HMD 100. The connectors 11B, 11C and 11D are interfaces to which external devices of the HMD 100 are connected. Although the type of the external device connected to the HMD 100 is not limited, in the present exemplary embodiment, as an example, a PC 300 is connected to the connector 11B, an image output device 400 is connected to a right display unit 22, and a power supply device 500 is connected to the connector 11D. PC is an abbreviation for Personal Computer. The PC 300 and the image output device 400 can be referred to as information processing devices. Note that, the PC 300 and the image output device 400 are merely examples of the information processing devices. For example, a desktop PC, a notebook PC, a tablet PC, a smartphone, and the like may be connected to the connection device 10 as an information processing device. As an aspect of a PC functioning as the information processing device, a so-called stick-type PC having a stick-type main body directly connected to the connector 11 of the connection device 10 may be used.

The connectors 11 are wired interfaces to be connected to a communication cable, and the connection device 10 is connected to the external device via the communication cable. The connector 11A includes a terminal configured to connect the display unit connection cable 40 and an interface circuit configured to transmit and receive a signal via the connector 11A. Similarly, the connector 11B includes a terminal configured to connect a cable and an interface circuit configured to transmit and receive a signal via the connector 11B. The same applies to the connectors 11C and 11D as well.

Here, the connector 11A corresponds to a first connection unit. The connector 11B has functions as a second connection unit and a third connection unit. That is, the connector 11B corresponds to the second connection unit, corresponds to the third connection unit, and is an aspect in which the second connection unit is formed integrally with the third connection unit. The connector 11C functions as a third connection unit, and the connector 11D functions as the second connection unit.

The connector 11A is provided to connect the image display unit 20 to the connection device 10. The display unit connection cable 40 performs to supply power with respect to the image display unit 20 from the connection device 10, and the display unit connection cable 40 has a function of mutually transmitting and receiving data between the image display unit 20 and the connection device 10.

For example, the connectors 11B, 11C and 11D are connectors conforming to a known communication interface standard, and the connectors may be connectors having the same shape or may be connectors having different types.

In the present exemplary embodiment, as an example, the connector 11B is an interface corresponding to input and output of image data and various data, to which the PC 300 is connected via a first connection cable 42. The connector 11C is an interface at least corresponding to input and output of the image data, to which the image output device 400 is connected via a second connection cable 44. The connector 11D is an interface at least corresponding to power supply with respect to the connection device 10, to which the power supply device 500 is connected via a third connection cable 46.

For example, a connector of a USB-Type C standard can be adopted as the connector 11B. The interface corresponding to the USB-Type C is capable of transmitting data according to a USB 3.1 standard and supplying a direct current within 20 volts and 5 amperes. Also, as a function of an alternative mode of the USB-Type C, the interface is capable of transmitting image data of an HDMI standard, image data of an MHL standard, and the like. The PC 300 is capable of supplying power, transmitting and receiving data, supplying streaming data of image and sound, and the like via the first connection cable 42. Here, USB is an abbreviation for Universal Serial Bus. MHL is an abbreviation for Mobile High-definition Link, and HDMI is an abbreviation for High Definition Multimedia Interface. The alternative mode of USB-Type C is known as Alternative mode. HDMI is a registered trademark.

For example, a connector conforming to the HDMI standard can be adopted as the connector 11C. Further, the connector 11D can adopt a connector of the USB-Type C standard or a MicroUSB connector. A connector of an interface standard capable of transmitting data and supplying power can be adopted as the connector 11D, and the connection device 10 can be configured to perform only supplying power by the connector 11D.

In the example illustrated in FIG. 1, the image output device 400 that outputs streaming data of image and sound by the second connection cable 44 is connected to the connector 11C. The image output device 400 is a device for playing content data recorded on a disc type recording medium such as CD or DVD. Further, a power supply device 500 that outputs a DC power supply of 5 volts is connected to the connector 11D via the third connection cable 46, and the connection device 10 receives power supply by the connector 11D.

In the present exemplary embodiment, the image display unit 20 has an eyeglasses-like shape. The image display unit 20 includes the right display unit 22, a left display unit 24, a right light-guiding plate 26, and a left light-guiding plate 28 on a main body including a right holding part 21, a left holding part 23, and a front frame 27.

The right display unit 22 and the left display unit 24 constitute the image display unit of the present disclosure. That is, only one of the right display unit 22 and the left display unit 24 may be used as the image display unit, or the combination of the right display unit 22 and the left display unit 24 may be configured to correspond to the image display unit.

The right holding part 21 and the left holding part 23 extend to a rearward side from both ends of the front frame 27 and hold the image display unit 20 on the head U of the user. In both ends of the front portion frame 27, when the image display unit 20 is mounted, the end located at the right side of the head U is defined as an end ER, while the end located at the left side is defined as an end EL. The right holding part 21 is provided to extend from the end ER of the front frame 27 to a position corresponding to a right side head part of the user in the state where the image display unit 20 is mounted. The left holding part 23 is provided to extend from the end EL to a position corresponding to a left side head part of the user in the state where the image display unit 20 is mounted.

The right light-guiding plate 26 and the left light-guiding plate 28 are provided on the front frame 27. The right light-guiding plate 26 is located in front of the right eye of the user in the state where the image display unit 20 is mounted, and the right light-guiding plate 26 allows the right eye to visually recognize the image. The left light-guiding plate 28 is located in front of the left eye of the user in the state where the image display unit 20 is mounted, and the left light-guiding plate 28 allows the left eye to visually recognize the image.

The front frame 27 has a shape coupling one end of the right light-guiding plate 26 and one end of the left light-guiding plate 28 to each other, and this coupling position corresponds to a portion between eyebrows of the user in the mounted state where the user wears the image display unit 20. The front frame 27 may be provided with a nose pad, in the coupling position of the right light-guiding plate 26 and the left light-guiding plate 28, configured to abut on a nose of the user in the state where the image display unit 20 is mounted. In this case, the image display unit 20 can be held on the head of the user by the nose pad, the right holding part 21, and the left holding part 23. Further, a belt, configured to be in contact with a back head part of the user in the state where the image display unit 20 is mounted, may be coupled to the right holding part 21 the left holding part 23, and, in this case, the image display unit 20 can be held on the head of the user by the belt.

Each of the right display unit 22 and the left display unit 24 is a module obtained by unitizing an optical unit and a peripheral circuit.

The right display unit 22 is a unit related to display of an image by the right light-guiding plate 26, and the right display unit 22 is provided on the right holding part 21 and is located near the right side head part of the user in the mounted state. The left display unit 24 is a unit related to image display by the left light-guiding plate 28, and the left display unit 24 is provided on the left holding part 23 and is located near the left side head part of the user in the mounted state. Note that, the right display unit 22 and the left display unit 24 may be collectively and simply referred to as a "display driving unit".

The right light-guiding plate 26 and the left light-guiding plate 28 are optical parts formed of a light transmissive resin or the like and are configured to guide imaging light output by the right display unit 22 and the left display unit 24 to the eyes of the user. The right light-guiding plate 26 and the left light-guiding plate 28 are, for example, prisms.

A dimmer plate may be provided on each of the surfaces of the right light-guiding plate 26 and the left light-guiding plate 28. The dimmer plate is an optical element being on a thin plate and having a different transmittance according to the wavelength range of light, and the dimmer plate functions as a so-called wavelength filter. The dimmer plate is, for example, disposed so as to cover a front side of the front frame 27, which is opposite side the eyes of the user. By appropriately selecting optical properties of this dimmer plate, a transmittance of light in any wavelength range such as visible light, infrared light, and ultraviolet light can be adjusted, and the amount of light outside light entering the right light-guiding plate 26 and the left light-guiding plate 28 from an outside and passing through the right light-guiding plate 26 and the left light-guiding plate 28 can be adjusted.

The HMD 100 is a see-through type display device, and the imaging light guided by the right light-guiding plate 26 and the outside light transmitted through the right light-guiding plate 26 is incident on the right eye of the user. Similarly, the imaging light guided by the left light-guiding plate 28 and the outside light transmitted through the left light-guiding plate 28 is incident on the left eye. As described above, the HMD 100 allows the imaging light corresponding to the image processed internally and the outside light to be incident on the eyes of the user in an overlapped manner, and the user can see an external scene through the right light-guiding plate 26 and the left light-guiding plate 28, and the user can visually recognize the image based on the imaging light overlapping on the external scene.

An illuminance sensor 65 is disposed on the front frame 27 of the image display unit 20. The illuminance sensor 65 receives the outside light from the front of the user wearing the image display unit 20.

A camera 61 is disposed on the front frame 27 of the image display unit 20. An imaging range and an imaging direction of the camera 61 will be described later. The camera 61 is provided at a position that the outside light passing through the right light-guiding plate 26 and the left light-guiding plate 28 is not blocked. In the example of FIG. 1, the camera 61 is disposed on a side of the end ER of the front frame 27, but the camera may also be disposed on a side of the end EL or may be disposed at a coupling portion between the right light-guiding plate 26 and the left light-guiding plate 28.

The camera 61 is disposed on the front frame 27. The camera 61 is provided at a position that the outside light passing through the right light-guiding plate 26 and the left light-guiding plate 28 is not blocked. In the example of FIG. 1, the camera 61 is disposed on a side of the end ER of the front frame 27, but the camera may also be disposed on a side of the end EL or may be disposed at a coupling portion between the right light-guiding plate 26 and the left light-guiding plate 28.

The camera 61 is a digital camera including an imaging element such as a CCD and a CMOS, an imaging lens, and the like, and the camera 61 according to the present exemplary embodiment is a monocular camera but may be configured by a stereo camera. The camera 61 captures at least a part of an external scene in a visual field direction of the user in a state where the HMD 100 is mounted, and an angle of view of the camera 61 faces in a front direction of the user and overlaps on the external scene visually recognized by the user through the image display unit 20. The external scene is the external real space perceived by the user with the naked eye. The angle of view of the camera 61 can be appropriately set.

A Light Emitting Diode (LED) indicator 67 is disposed on the front frame 27. The LED indicator 67 is disposed adjacent to the camera 61 at the end ER and is configured to light up while the camera 61 is operating to notify that the capturing is in progress.

A distance sensor 64 is provided on the front frame 27. The distance sensor 64 is configured to detect a distance to a target object to be measured located in a preset measurement direction. The distance sensor 64 may be a light reflecting type distance sensor including a light source, such as an LED or a laser diode, and a light-receiving unit configured to receive the reflected light such that the light emitted by the light source is reflected by the target object to be measured, for example. Further, the distance sensor 64 may be an ultrasonic wave type distance sensor including a sound source, configured to generate ultrasonic waves, and a detector, configured to receive the ultrasonic waves reflected by the target object to be measured. Further, the distance sensor 64 may use a laser range scanner, and, in this case, measuring a region with respect to a wide region including the front of the image display unit 20 can be performed.

Each of the right display unit 22 and the left display unit 24 of the image display unit 20 is connected to the connection device 10. In the HMD 100, the display unit connection cable 40 is connected to the left holding part 23, and wiring connected to the display unit connection cable 40 is laid inside the image display unit 20 to connect each of the right display unit 22 and the left display unit 24 to the connection device 10.

The connection cable 40 includes an audio connector 36, wherein a headset 30, including a right earphone 32 and a left earphone 34 constituting a stereo headphone and a microphone 63, is connected to the audio connector 36. The right earphone 32 is mounted on the right ear of the user, and the left earphone 34 is mounted on the left ear of the user. The right earphone 32 and the left earphone 34 can also be referred to as a sound output unit.

The right earphone 32 and the left earphone 34 output a sound based on a sound signal output from the connection device 10.

The microphone 63 is configured to collect a sound and to output the sound signal to the connection device 10. The microphone 63 may be a monaural microphone or a stereo microphone, for example, or may be a directional microphone or a non-directional microphone.

The connection device 10 includes a power button 12, brightness adjusting buttons 13, 14, and sound volume adjusting buttons 15, 16 as operated parts to be operated by the user. These operated parts are disposed on the surface of the main body of the connection device 10, for example, and may be operated by fingers of the user.

The power button 12 is a button configured to instruct turning on/off the power of the HMD 100. The brightness adjusting buttons 13 and 14 are buttons configured to adjust display brightness of the image displayed by the image display unit 20. The brightness adjusting button 13 is configured to instruct an increase in brightness, and the brightness adjusting button 14 is configured to instruct a reduction in brightness. The volume adjusting buttons 15, 16 are buttons configured to adjust volume of the sound output from the right earphone 32 and the left earphone 34. The volume adjusting button 15 is configured to instruct an increase in volume, and the sound volume adjusting button 16 is configured to instruct a reduction in volume.

Further, the connection device 10 includes an indicator 17 configured to display an operation state of the HMD 100. The indicator 17 includes an LED, for example, and lights up in red in a case where the power of the HMD 100 is on. Here, the LED is an abbreviation for Light Emitting Diode. Additionally, the indicator 17 lights up in white in a case of receiving an operation on the operated parts to be operated described above.

1-2. Control System of Display System

Figure 2:
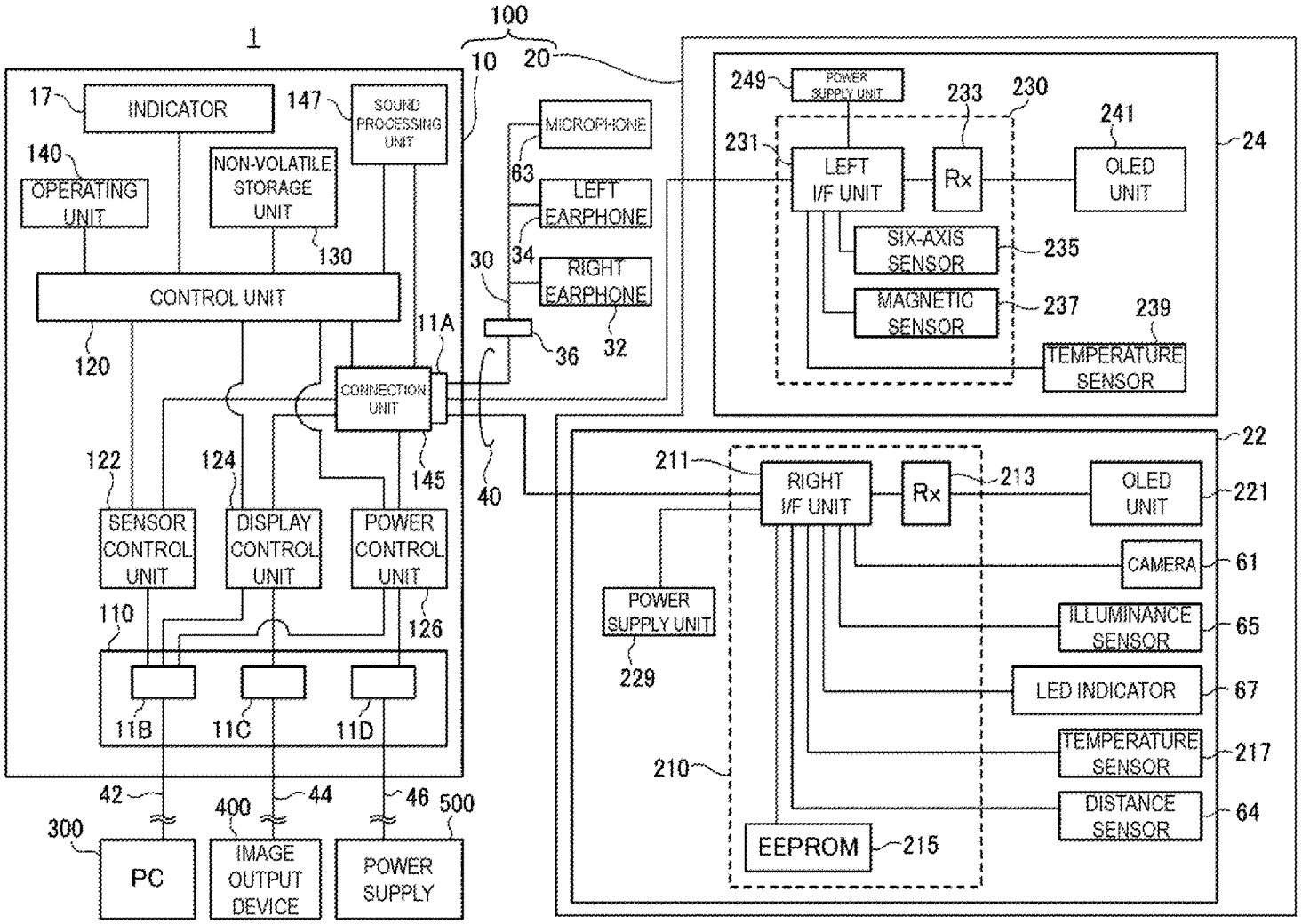
FIG. 2 is a block diagram of the display system.

FIG. 2 is a block diagram of the display system 1, illustrating the configuration of the HMD 100 in detail.

The right display unit 22 of the image display unit 20 includes a right display unit substrate 210. On the right display unit substrate 210, a right I/F unit 211 connected to the display unit connection cable 40, a receiving unit 213 that receives data input from the connection device 10 via the right I/F unit 211, and an EEPROM 215 are mounted. The right I/F unit 211 connects the receiving unit 213, the EEPROM 215, a temperature sensor 217, the camera 61, the distance sensor 64, the illuminance sensor 65, and the LED indicator 67 to the connection device 10. The receiving unit 213 connects an OLED unit 221 to the connection device 10.

The left display unit 24 includes a left display unit substrate 230. On the left display unit substrate 230, a left I/F unit 231 connected to the display unit connection cable 40, a receiving unit 233 that receives data input from the connection device 10 via the left I/F unit 231 are mounted. Further, the left display unit substrate 230 is mounted with a six-axis sensor 235 and a magnetic sensor 237.

The left I/F unit 231 connects the receiving unit 233, the six-axis sensor 235, the magnetic sensor 237, and a temperature sensor 239 to the connection device 10. The receiving unit 233 connects an OLED unit 241 to the connection device 10.

I/F is an abbreviation for interface. EEPROM is an abbreviation for Electrically Erasable Programmable Read- Only Memory. OLED is an abbreviation for Organic Light Emitting Diode. In the following description, the receiving unit 213 and the receiving unit 233 will be referred to as Rx 213 and Rx 233, respectively.

The EEPROM 215 is configured to store various types of data in a non-volatile manner. The EEPROM 215 stores, for example, data regarding light-emitting properties and display properties of the OLED units 221 and 241 included in the image display unit 20, data regarding properties of a sensor included in the right display unit 22 or the left display unit 24, and the like. Specifically, the EEPROM 215 stores parameters regarding gamma correction of the OLED units 221 and 241, data used to compensate for detection values of the temperature sensors 217 and 239, and the like. These kinds of data are generated by inspection at the time of factory shipment of the HMD 100 and are written into the EEPROM 215. The data stored in the EEPROM 215 can be read by a control unit 120.

The camera 61 is configured to execute imaging in accordance with a signal input via the right I/F unit 211 and configured to output captured image data to the right I/F unit 211. The illuminance sensor 65 is configured to receive the outside light and to output a detection value corresponding to an amount of the received light or an intensity of the received light. The LED indicator 67 is configured to light up in accordance with a control signal or a driving current input via the right I/F unit 211.

The temperature sensor 217 is configured to detect a temperature of the OLED unit 221 and to output a voltage value or a resistance value corresponding to the detected temperature as a detection value.

The distance sensor 64 is configured to execute distance detection and to output a signal indicating detection results to the connection device 10 via the right I/F unit 211. As the distance sensor 64, for example, an infrared ray type depth sensor, an ultrasonic type distance sensor, a Time Of Flight distance sensor, a distance detecting unit configured to combine image detection and sound detection, or the like can be used. Additionally, the distance sensor 64 may be configured to process an image obtained by stereo photographing by a stereo camera or a monocular camera to detect a distance.

The receiving unit 213 is configured to receive image data for displaying transmitted from the connection device 10 via the right I/F unit 211 and to output the image data to the OLED unit 221. The OLED unit 221 is configured to display an image based on the image data transmitted by the connection device 10.

Further, the receiving unit 233 is configured to receive image data for displaying transmitted from the connection device 10 via the left I/F unit 231 and configured to output the image data to the OLED unit 241. The OLED units 221 and 241 are configured to display an image based on the image data transmitted by the connection device 10.

The six-axis sensor 235 is a motion sensor including a three-axis acceleration sensor and a three-axis gyro sensor. The six-axis sensor 235 may adopt an IMU in which the sensors described above are provided as modules. The magnetic sensor 237 is a three-axis geomagnetic sensor, for example. A gyro sensor is also referred to as an angular velocity sensor. In addition, a motion sensor may be paraphrased as a completed sensor. IMU is an abbreviation for Inertial Measurement Unit.

The temperature sensor 239 is configured to detect a temperature of the OLED unit 241 and to output a voltage value or a resistance value corresponding to the detected temperature as a detection value.

Each part of the image display unit 20 operates with power supplied from the connection device 10 via the display unit connection cable 40.

The image display unit 20 includes a power supply unit 229 in the right display unit 22 and includes a power supply unit 249 in the left display unit 24. The power supply unit 229 is configured to distribute and supply the power supplied by the connection device 10 via the display unit connection cable 40 to each part of the right display unit 22 including the right display unit substrate 210. Similarly, the power supply unit 249 is configured to distribute and supply the power supplied by the connection device 10 via the display unit connection cable 40 to each part of the left display unit 24 including the left display unit substrate 230. The right display unit 22 and the left display unit 24 may include a conversion circuit or the like configured to convert a voltage.

The connection device 10 includes an I/F unit 110, the control unit 120, a sensor control unit 122, a display control unit 124, a power control unit 126, a non-volatile storage unit 130, an operating unit 140, a connection unit 145, and a sound processing unit 147.

The I/F unit 110 includes the connectors 11B, 11C and 11D. Further, the I/F unit 110 includes interface circuits connected to the connectors 11B, 11C, and 11D and configured to execute communication protocols conforming to respective communication standards.

The I/F unit 110 may be, for example, an interface substrate on which the connectors 11B, 11C, and 11D, and the interface circuit are mounted. Further, a configuration may be adopted in which the control unit 120, the sensor control unit 122, the display control unit 124, and the power control unit 126 of the connection device 10 are mounted on a connection device main substrate (not illustrated). In this case, on the connection device main substrate, the connectors 11B, 11C, and 11D of the I/F unit 110 and the interface circuit may be mounted.

Additionally, the I/F unit 110 may include, for example, an interface for a memory card capable of being connected to an external storage medium or the like, or the I/F unit 110 may be configured by a wireless communication interface.

The control unit 120 is configured to control each part of the connecting device 10. The control unit 120 executes a program by a processor 150 (FIG. 3) to be described later and controls each part of the HMD 100 in cooperation of software and hardware. The control unit 120 is connected to the non-volatile storage unit 130, the operating unit 140, the connection unit 145, and the sound processing unit 147.

The sensor control unit 122 is configured to control the camera 61, the distance sensor 64, the illuminance sensor 65, the temperature sensor 217, the six-axis sensor 235, the magnetic sensor 237, and the temperature sensor 239. Specifically, the sensor control unit 122 is configured to perform setting and initialization of a sampling period of each sensor according to control of the control unit 120 and configured to execute energization to each sensor, transmission of control data, acquisition of detection values, and the like, in correspondence to the sampling period of each sensor.

The sensor control unit 122 is connected to the connector 11B of the I/F unit 110 and is configured to output the data regarding the detection value acquired from each sensor to the connector 11B at a preset timing. The device connected to the connector 11B can acquire the detection value of each sensor of the HMD 100 and the captured image data of the camera 61. In the present exemplary embodiment, the detection value of each sensor and the captured image data of the camera 61 are output to the PC 300 by the sensor control unit 122. The data output by the sensor control unit 122 may be digital data including the detection value. Further, the sensor control unit 122 may be configured to output data of results obtained by an arithmetic operation based on the detection value of each sensor. For example, the sensor control unit 122 is configured to integrally process detection values of a plurality of sensors and to function as a so-called sensor fusion processing unit. By executing the sensor fusion, the sensor control unit 122 outputs data obtained from the detection values of the sensors, for example, track data of movement of the image display unit 20, relative coordinate data of the image display unit 20, and the like. The sensor control unit 122 may have a function of transmitting/receiving various kinds of control data relating to transmission of data to/from a device connected to the connector 11B.

The display control unit 124 is configured to execute various kinds of processing for the image display unit 20 to display an image based on image data; or image data input to the I/F unit 110. For example, the display control unit 124 is configured to execute various kinds of processing such as cutting out of a frame, resolution conversion, intermediate frame generation, and frame rate conversion. Resolution conversion includes so-called scaling. The display control unit 124 is configured to output image data corresponding to each of the OLED unit 221 and the OLED unit 241 to the connection unit 145. The image data input to the connection unit 145 are transmitted from the connector 11A to the right I/F unit 211 and the left I/F unit 231.

For example, in a case where the image data input to the I/F unit 110 are 3D image data, the display control unit 124 is configured to execute 3D image decoding. The 3D image includes stereoscopic video in a broad sense. In processing of the 3D image decoding, the display control unit 124 is configured to generate a frame for the right eye and a frame for the left eye from the 3D image data. Formats of the 3D image data input to the I/F unit 110, for example, include a side by side format, a top and bottom format, a frame packing format, and the like, but 3D model data may be used.

The display control unit 124 is connected to the connector 11B and the connector 11C. The display control unit 124 is configured to execute processing on image data input to the connector 11B and image data input to the connector 11C as targets to be processed. Further, the display control unit 124 may have a function of transmitting/receiving various kinds of control data regarding transmission of image data to/from a device connected to the connector 11B or the connector 11C.

In the present exemplary embodiment, the connector 11B is configured by a USB-Type C connector. The display control unit 124 is configured to receive the image data transmitted in the alternative mode of the USB-Type C via the connector 11B. The connector 11C is, for example, an HDMI interface, and the display control unit 124 is configured to receive the image data in the HDMI standard input to the connector 11C.

The sensor control unit 122 and/or the display control unit 124 may be realized by cooperation of software and hardware by a processor executing a program. That is, the sensor control unit 122 and the display control unit 124 are configured by a processor to execute a program to execute the operations described above. In this example, the sensor control unit 122 and the display control unit 124 may be realized by a processor constituting the control unit 120 executing a program. In other words, the processor may function as the control unit 120, the display control unit 124, and the sensor control unit 122 by executing the program. Here, the processor can be paraphrased as a computer.

Further, the display control unit 124 and the sensor control unit 122 may include programmed hardware such as DSP or FPGA. Further, the sensor control unit 122 and the display control unit 124 may be integrated to be configured of an SoC-FPGA. DSP is an abbreviation for Digital Signal Processor, FPGA is an abbreviation for Field Programmable Gate Array, and SoC is an abbreviation for System-on-a-Chip.

The power control unit 126 is connected to the connector 11C and the connector 11D. The power control unit 126 is configured to supply power to each part of the connection device 10 and the image display unit 20 based on the power supplied from the connectors 11C and 11D. Further, the power control unit 126 may be configured to include a voltage conversion circuit (not illustrated), to convert the voltage, and to supply the voltage to each part of the connection device 10 and the image display unit 20. The power control unit 126 may be configured of a programmed semiconductor device such as a logic circuit and the FPGA. Further, the power control unit 126 may be configured of hardware common to the sensor control unit 122 and/or the display control unit 124.

Each of the sensor control unit 122, the display control unit 124, and the power control unit 126 may include a work memory for executing data processing and may execute processing by using a memory 160 (FIG. 3) of the control unit 120.

The operating unit 140 is configured to detect an operation on an operated part included in the connection device 10 and to output data indicating an operation content or an operation signal indicating the part to be operated to the control unit 120.

The sound processing unit 147 is configured to generate a sound signal according to sound data that is input from the control unit 120 and configured to output the sound signal to the connection unit 145. This sound signal is output from the connection unit 145 to the right earphone 32 and the left earphone 34 via the audio connector 36. Additionally, the sound processing unit 147 is configured to adjust the volume of the sound signal under the control of the control unit 120. Additionally, the sound processing unit 147 is configured to generate sound data of the sound collected by the microphone 63 and configured to output the sound data to the control unit 120. This sound data may be processed by the control unit 120 in the same manner as the detection value of the sensor included in the image display unit 20.

Additionally, the connection device 10 may be configured to include a battery not illustrated and to supply power from the battery to each part of the connection device 10 and the image display unit 20. The battery included the connection device 10 may be a rechargeable secondary battery.

Figure 3:
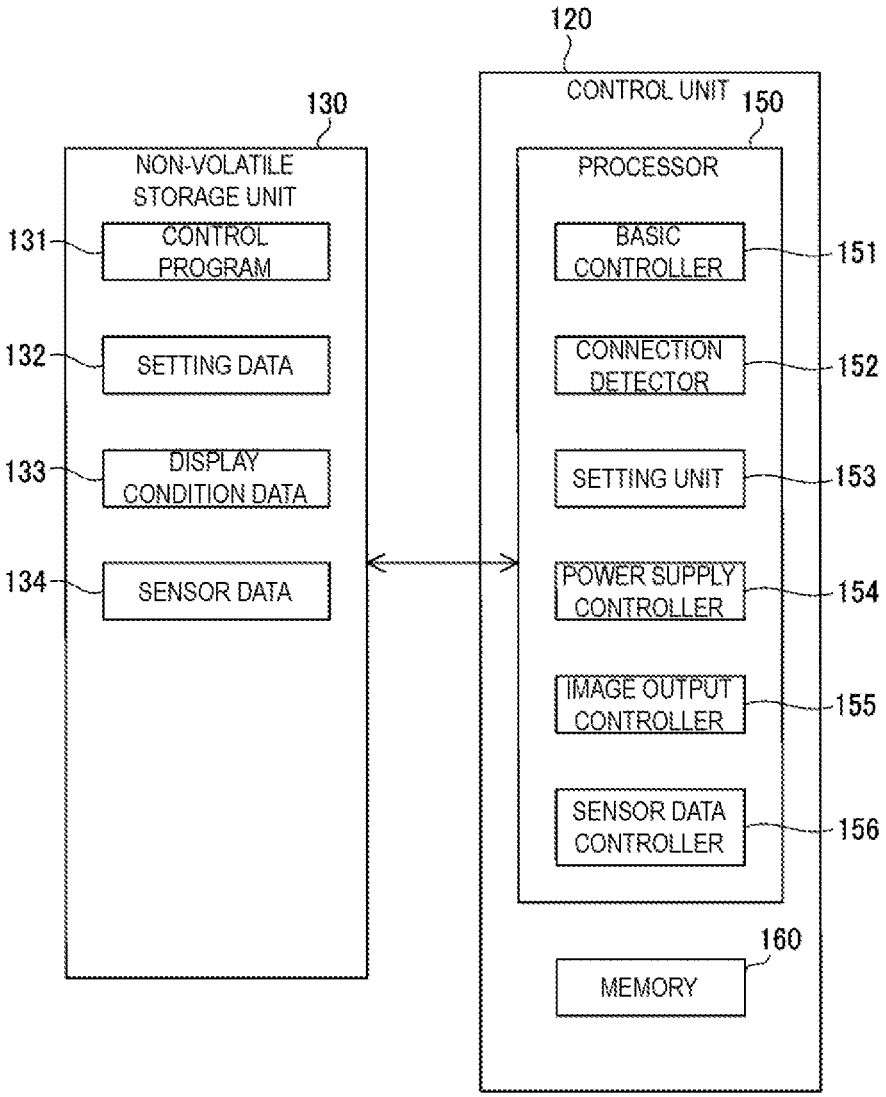
FIG. 3 is a functional block diagram of a control system of an HMD.

FIG. 3 is a functional block diagram of a control system of the HMD 100 and illustrates functional configurations of the control unit 120 and the non-volatile storage unit 130 in detail.

The control unit 120 includes the processor 150 and the memory 160. The processor 150 is configured of a CPU, a microcomputer, and the like and executes a program to control each part of the HMD 100 in cooperation of software and hardware. The processor 150 may be programmed hardware such as DSP or FPGA.

The memory 160 is configured of a RAM for forming a work area of the processor 150, a ROM for storing a control program, and the like. Further, the control unit 120 may be a semiconductor device integrating the processor 150 and the memory 160. CPU is an abbreviation for Central Processing Unit, RAM is an abbreviation for Random Access Memory, and ROM is an abbreviation for Read Only Memory.

The non-volatile storage unit 130 is a storage device configured to store data to be processed by the control unit 120 and the like in a non-volatile manner. The non-volatile storage unit 130 is, for example, a magnetic recording device such as an HDD or is a storage device using a semiconductor storage element such as a flash memory. HDD is an abbreviation for Hard Disk Drive.

The non-volatile storage unit 130 stores a control program 131 to be executed by the processor 150. Additionally, the non-volatile storage unit 130 stores setting data 132, display condition data 133, and sensor data 134 as data to be processed by the processor 150. The display condition data 133 correspond to the display condition of the present disclosure, and the non-volatile storage unit 130 corresponds to the storage unit.

By executing the program, the processor 150 is configured by a basic controller 151, a connection detector 152, a setting unit 153, a power supply controller 154, an image output controller 155, and a sensor data controller 156.

The basic controller 151 is a control unit configured to control each part of the HMD 100 and executes a function of a so-called operating system. Further, the basic controller 151 may execute a function of application program operating on the operating system. The configuration in which the control unit 120 executes the operating system is merely one aspect, and applying the present disclosure to a configuration is certainly capable in which the processor 150 is programmed hardware and does not use an operating system.

The basic controller 151 is configured to determine the operation content detected by the operating unit 140. Further, the basic controller 151 outputs the sound data to the sound processing unit 147 and causes to output the sound signal based on the sound data to the right earphone 32 and the left earphone 34. Additionally, the basic controller 151 is configured to adjust the volume of the sound signal output from the sound processing unit 147 based on the operation detected by the operating unit 140.

The basic controller 151 is configured to control start and stop of powering the LED indicator 67. For example, the basic controller 151 lights up or blinks the LED indicator 67 in correspondence to timing at which the camera 61 starts and ends imaging.

The connection detector 152 is configured to control the sensor control unit 122, the display control unit 124, the power control unit 126, and the connection unit 145 and configured to detect the connection states of the connectors 11A, 11B, 11C, and 11D. The connection detector 152 is configured to determine whether the image display unit 20 is connected to the connector 11A. Additionally, the connection detector 152 is configured to determine whether there is a connection of an external device to the connectors 11B, 11C, and 11D and configured to perform a determination of the connected external device. The connection detector 152 is configured to control the sensor control unit 122, the display control unit 124, and the power control unit 126 such that the sensor control unit 122, the display control unit 124, and the power control unit 126 execute operations appropriate for each device connected via the I/F unit 110.

In the present exemplary embodiment, a configuration in which the I/F unit 110 includes the connectors 11A, 11B, 11C, and 11D to be wired is illustrated. In this configuration, the connection detector 152 may be configured to detect that the cables compatible with each of the connectors are connected to the connectors 11A, 11B, 11C, and 11D. Alternatively, the connection detector 152 may be configured to detect that the external device or the image display unit 20 is connected via a cable with respect to the connectors 11A, 11B, 11C, and 11D. Alternatively, the connection detector 152 may detect that an image signal and power are being supplied from the external device via the cable regarding the connectors 11B, 11C, and 11D. Further, the connection detector 152 may distinguish and detect a state where the connectors 11A, 11B, 11C, and 11D are connected to the cable, a state where the external device or the connector 11A is connected via the cable, and a state where the image and power are supplied via the cable.

The setting unit 153 generates and updates the setting data 132 and the display condition data 133 according to the operation of the operated part included in the connection device 10.

The power supply controller 154 is configured to control power supply from the power control unit 126 to each part of the connection device 10 and the connection unit 145. Specifically, in a case where the power control unit 126 receives power supply from the connector 11B or the connector 11D, the power supply controller 154 executes power supply to each part of the connection device 10 based on the supplied power, and the power supply controller 154 further executes power supply to the power supply units 229 and 249. Further, the power supply controller 154 is configured to monitor the power supply state to the power control unit 126 and to control the operation state of the connection device 10.

Further, the power supply controller 154 is configured to control an operation mode of the HMD 100. The operation mode of the HMD 100 includes at least a normal operation mode in which an image can be displayed and a power saving mode. The normal operation mode is an operation mode in which power is supplied to each part of the HMD 100, and each part can execute operations. In contrast, in the power saving mode, a power consumption of the HMD 100 is less than that in the normal operation mode.

The power supply controller 154 is configured to determine whether a preset condition regarding the operation of the image display unit 20 is satisfied based on an operation with respect to the operating unit 140 or a detection state of the sensor of the image display unit 20. In a case where the preset condition is satisfied, the power supply controller 154 executes the transition from the normal operation mode to the power saving mode; and the transition from the power saving mode to the normal operation mode.

For example, in the normal operation mode, the power supply controller 154 shifts to the power saving mode in a case where a state, in which there is no operation on the operating unit 140, and a state, in which the detection value of the sensor of the image display unit 20 is not greater than a preset threshold value, continue for a set time or more. Further, in the power saving mode, in a case where an operation with respect to the operating unit 140 is executed, the operation mode is shifted to the normal operation mode. Further, in the power saving mode, in a case where the detection value of the sensor of the image display unit 20 is greater than the preset threshold value, the operation mode is shifted to the normal operation mode.

In the power saving mode, the power of each part including the OLED units 221 and 241 is turned off, and a sampling frequency of the detection value of each sensor included in the image display unit 20 is set to be lower than the normal operation mode. Further, in the power saving mode, power supply to each part including the indicator 17 and the sound processing section 147 is stopped. In each of these parts, power is supplied in the normal operation mode, and the power is turned on.

The image output controller 155 is configured to read data from the EEPROM 215 and to set operations of the sensor control unit 122 and the display control unit 124 based on the read data. The image output controller 155 generates an image signal based on the image data received by the display control unit 124 and outputs the image signal to the connection unit 145. Further, in a case where the image data received by the display control unit 124 accompanies the sound data, the image output controller 155 outputs the sound data to the sound processing unit 147.

In a case where a plurality of external devices are connected to the connectors 11B and 11C provided in the I/F unit 110, the image output controller 155 switches the image to be displayed by the image display unit 20. Here, among the devices that supply the image data with respect to the connection device 10, the device that outputs the image data to be displayed by the image display unit 20 is referred to as an image source. The image output controller 155 selects one of the plurality of external devices connected to the connectors 11B and 11C as the image source and causes the image display unit 20 to display image based on the image data supplied by the selected external device. The image output controller 155 switches the image source based on the operation detected by the operating unit 140 and based on the detection value of the sensor of the image display unit 20.

In a case where no image signal is input from an external device selected as an image source, the image output controller 155 may generate a notification image and output an image signal based on the notification image from the connector 11A. Specifically, in a case where it is detected that the cable is connected to the connectors 11B and 11C and in a case where it is detected that the external device is connected via the cable, the connection detector 152 selects an image source. Here, the connection detector 152 monitors the image signal input from the selected image source, and in a case where no image signal is input, the image signal of the notification image indicating that there is no image is output from the connection detector 152. The notification image is a character string such as "No Signal", an image, or the like, for example, and is an image for notifying the user that there is no image signal. The image output controller 155 causes the image signal of the notification image to be output from the connection unit 145 based on the data of the notification image stored in the non-volatile storage unit 130 or the data generated by the image output controller 155.

The sensor data controller 156 is configured to control the output of data by the sensor control unit 122. The sensor data controller 156 causes the data of each sensor included in the image display unit 20 and captured image data of the camera 61 to be acquired by the sensor control unit 122. The sensor data controller 156 outputs data of each sensor included in the image display unit 20 and captured image data of the camera 61 via a connector connected to the sensor control unit 122 in the I/F unit 110. Further, in a case where the sensor control unit 122 receives control data for requesting data of the sensor from the external device, the sensor data controller 156 responds to the received request and controls the output of the sensor control unit 122.

In a case where the power of the HMD 100 is switched on by the operation of the power button 12 (FIG. 1) or in a case where the connection detector 152 detects the start of the power supply from the external device, the control unit 120 executes activation control of the HMD 100. The activation control of the HMD 100 is executed by the image output controller 155 based on the detection state of the connection detector 152.

The operation in a case where the HMD 100 is activated can be set in at least three modes. Hereinafter, they are referred to as a first display mode, a second display mode, and a third display mode.

In the first display mode, the control unit 120 executes initialization of the image display unit 20. The initialization process includes, for example, the start of power supply to each part of the image display unit 20, initialization and activation of each sensor provided in the image display unit 20, and initialization of the OLED units 221 and 241. In the first display mode, the control unit 120 outputs an image signal based on the image data received by the display control unit 124 to the image display unit 20, and the control unit 120 causes the right display unit 22 and the left display unit 24 to start displaying the image. Further, in the first display mode, the control unit 120 sets a function to cause the image display unit 20 to stop displaying the image to be disabled. The function to cause the image display unit 20 to stop displaying the image is, for example, a sleep function and a mute function. Further, in the first display mode, the control unit 120 sets the operation for turning off the power supply of the HMD 100 to be disabled.

The sleep function is a function to shift from the normal operation mode to the power saving mode. When the sleep function is disabled, the HMD 100 maintains the normal operation mode and does not shift to the power saving mode even if the operating unit 140 detects an operation instructing the shift to the power saving mode.

The mute function is a function to cause the right display unit 22 and the left display unit 24 to stop displaying the image in the normal operation mode. The mute function is started by an operation with respect to the operated parts included in the connection device 10. In a case where the operation instructing the execution of the mute function is detected by the operating unit 140, the image output controller 155 causes the right display unit 22 and the left display unit 24 to stop displaying the image. For example, the image output controller 155 temporarily stops outputting the image data from the connection unit 145 to the right display unit 22 and the left display unit 24. Alternatively, the image output controller 155 may stop the power supply to the OLED units 221 and 241 by the function of the power supply controller 154. The mute function is a function to temporarily stop the right display unit 22 and the left display unit 24 from displaying the image, and the mute function is also executed while the display control unit 124 is receiving the image data. Further, in a case of releasing the mute function, the image output controller 155 causes the image to be displayed on the right display unit 22 and the left display unit 24 based on the image data received by the display control unit 124 after the mute function is released. Execution and release of the mute function are instructed by an operation of the user on the connection device 10. In addition, during the execution of the mute function, sound output from the right earphone 32 and the left earphone 34 may be stopped.

In a case where the activation control of the HMD 100 is executed in the first display mode, the control unit 120 sets an operation for turning off the power supply of the HMD 100 to be disabled. Specifically, the operation for turning off the power supply of the HMD 100 is an operation of pressing the power button 12. The assignment of the function of the power button 12 is arbitrary, for example, an operation of pressing the power button 12 for a time shorter than a set time can be assigned to the instruction of the sleep function. In this case, the operation of continuously pressing the power button 12 for a time not less than the set time can be assigned to an operation to turn off the power of the HMD 100. In the first display mode, even if the power button 12 is operated, the processing of turning off the power of the HMD 100 is not executed. Therefore, for example, the HMD is turned off by removing the external device from the connectors 11B, 11C and 11D.

In the first display mode, the sleep function and the operation of turning off the power is disabled. According to the assignment of the function of the power button 12, in the first display mode, the HMD 100 is started in a state where the operation of the power button 12 is disabled.

In the second display mode, the control unit 120 does not execute the initialization of the image display unit 20 and the display of the image by the image display unit 20, and the control unit 120 waits until the operating unit 140 detects the operation. In this state, the image display unit 20 does not display the image. When the operation with respect to the operated part of the operating unit 140 is detected, the control unit 120 executes the initialization of the image display unit 20. Processing of the initialization is the same as in the first display mode.

In the third display mode, the control unit 120 executes the initialization of the image display unit 20. Processing of the initialization is the same as in the first display mode. In the second display mode, after the initialization, the control unit 120 outputs the image signal based on the image data received by the display control unit 124 to the image display unit 20, and the control unit 120 causes the right display unit 22 and the left display unit 24 to start displaying the image. That is, in the third display mode, operations after the initialization is started are common to the second display mode.

In the second display mode and the third display mode, the control unit 120 does not set each of the functions involving the display stop of the image display unit 20 to be disabled including the mute function and the sleep function. In other words, the control unit 120 sets these functions to be enabled. In addition, in the second display mode and the third display mode, the control unit 120 can execute an end sequence to turn off the power of the HMD 100 according to the operation of the power button 12.

The control program 131 stored in the non-volatile storage unit 130 is a program to be executed by the processor 150. The control program 131 corresponds to the functions of the basic controller 151, the connection detector 152, the setting unit 153, the power supply controller 154, the image output controller 155, and the sensor data controller 156.

The setting data 132 are data including various setting contents regarding the operation of the HMD 100. The display condition data 133 designate the activation control executed by the control unit 120 at the time of activation of the HMD 100. Specifically, the display condition data 133 include information that designates whether the activation control executed at the time of activation of the HMD 100 is the first display mode, the second display mode, or the third display mode.

The sensor data 134 includes detected values acquired from the sensors provided in the image display unit 20 by the sensor data controller 156 and captured image data of the camera 61. The sensor data controller 156 temporarily stores the detection value of the sensor and the captured image data as the sensor data 134 and outputs them by the sensor control unit 122. The sensor data 134 may include the sound data of the sound collected by the microphone 63.

Figure 4:
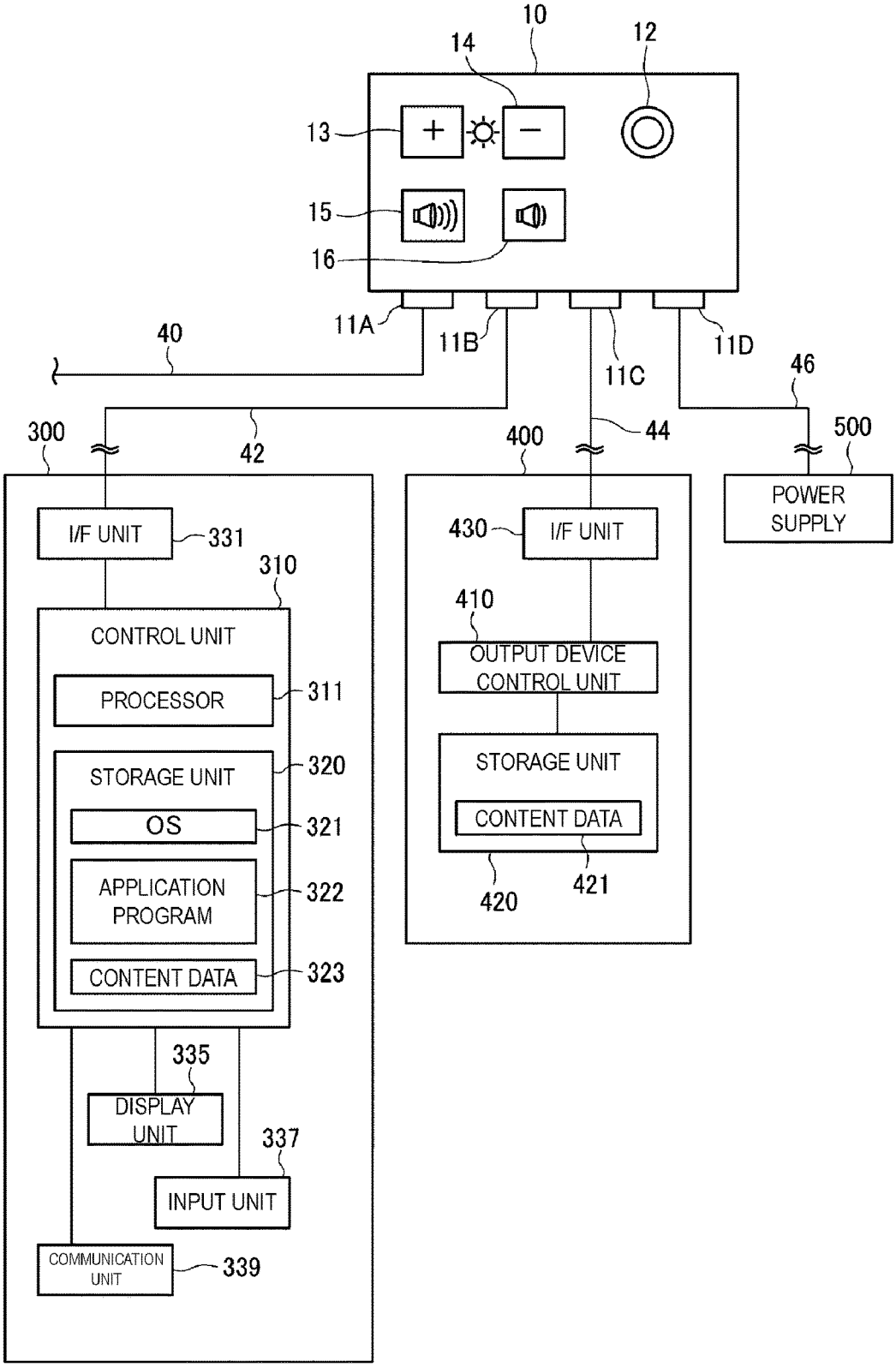
FIG. 4 is a block diagram of a device connected to the HMD.

FIG. 4 is a block diagram of a device connected to the HMD 100.

The PC 300 includes a control unit 310, a storage unit 320, an I/F unit 331, a display unit 335, an input unit 337, and a communication unit 339.

The control unit 310 includes a processor 311 and the storage unit 320. The processor 311 is configured by a CPU, a microcomputer, and the like and is configured to execute a program to control each part of the PC 300 in cooperation of software and hardware. The processor 311 may be a programmed hardware such as DSP or FPGA.

The storage unit 320 is configured of a RAM that forms a work area of the processor 311, a ROM that stores a control program, and the like. Further, the control unit 310 may be a semiconductor device integrating the processor 311 and the storage unit 320. Further, the storage unit 320 may be a magnetic recording device such as an HDD or a non-volatile storage device using a semiconductor storage element such as a flash memory.

The storage unit 320 stores an operating system 321 which is a program to be executed by the processor 311; and an application program 322. The operating system is expressed as OS in the figure. Further, the storage unit 320 stores content data 323.

The I/F unit 331 is an interface connected to an external device, to which the connection device 10 is connected via the first connection cable 42 in the present exemplary embodiment. The I/F unit 331 is configured to execute communication conforming to, for example, a standard such as an HDMI interface and a USB interface. The I/F unit 331 includes a connector to be connected to the first connection cable 42, an interface circuit configured to process a signal transmitted via the connector, and the like.

The display unit 335 includes a display screen such as a liquid crystal display panel, and the display unit 335 displays processing results and the like processed by the processor 311.

The input unit 337 detects an input by an input device such as a keyboard or a mouse; or an input by a touch sensor laid on the surface of the display unit 335.

The communication unit 339 is a communication interface configured to execute data communication with an external device. The communication unit 339 may be a wired communication interface capable of being connected to a cable or may be a wireless communication interface.

The processor 311 executes the operating system 321 and the application program 322 to control each part of the PC 300 and to reproduce the content data 323. The processor 311 outputs the image data and sound data included in the content data 323 to the connection device 10 by the I/F unit 331.

Further, the processor 311 mutually executes data communication with the connection device 10 via the first connection cable 42. The processor 311 is configured to request the captured image data of the camera 61 provided in the HMD 100; and the detection values of the distance sensor 64, the illuminance sensor 65, the six-axis sensor 235, the magnetic sensor 237, and the like, with respect to the connection device 10. For example, the processor 311 edits or generates image data to be output to the connection device 10 based on the captured image data and the detection value acquired from the connection device 10 by the function of the application program 322.

The image output device 400 includes an output device control unit 410, a storage unit 420, and an I/F unit 430. The output device control unit 410 includes a processor (not illustrated) and is configured to cause the processor to execute a program to control each part of the image output device 400 in cooperation of software and hardware. The processor of the output device control unit 410 may be a programmed hardware such as DSP or FPGA.

The storage unit 420 stores programs to be executed by the output device control unit 410 and data to be processed by the output device control unit 410. Further, the storage unit 420 stores content data 421. The I/F unit 430 is an interface connected to an external device by wired or wireless connection, to which the connection device 10 is connected via the second connection cable 44 in the present exemplary embodiment.

The output device control unit 410 reproduces the content data 421 stored in the storage unit 420 and outputs the image data and the sound data included in the content data 421 to the connection device 10 by the I/F unit 430.

The image output device 400 may be a device that reads and reproduces the content data 421 recorded on a portable recording medium such as a CD or DVD. Further, the image output device 400 may include a communication unit configured to execute data communication and may output image data and sound data received from an external server by the communication unit via the I/F unit 430.

1-3. Operation of Display System

Figure 5:
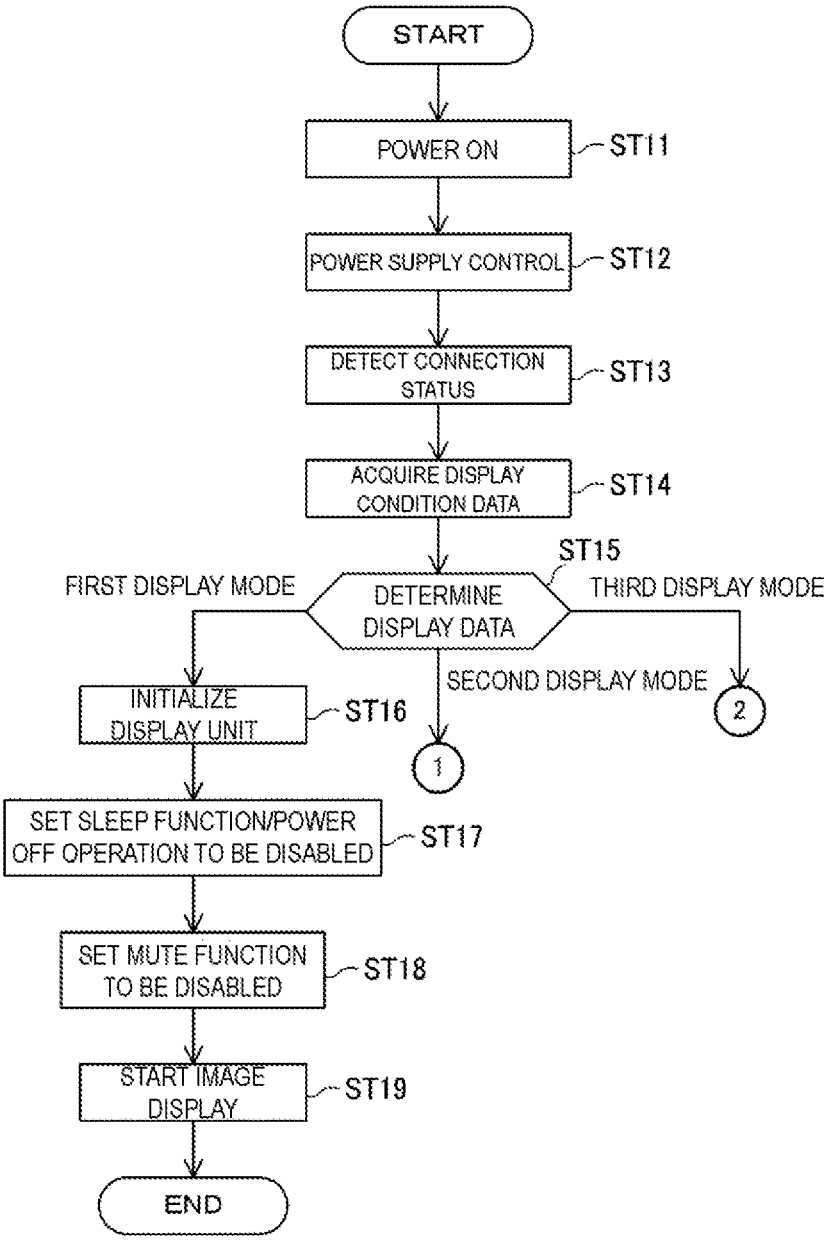
FIG. 5 is a flowchart illustrating operations of the HMD.
Figure 6:
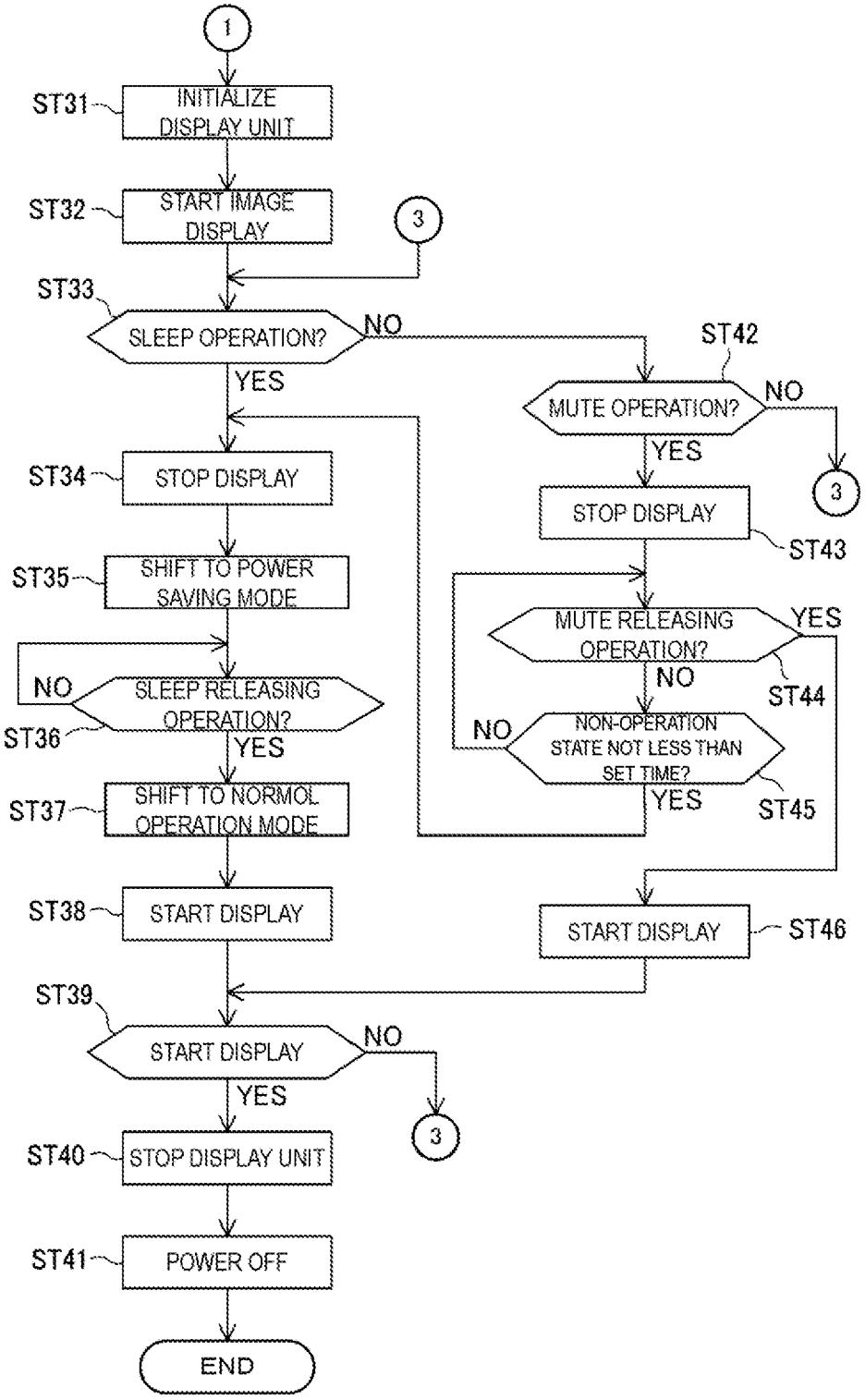
FIG. 6 is a flowchart illustrating operations of the HMD.
Figure 7:
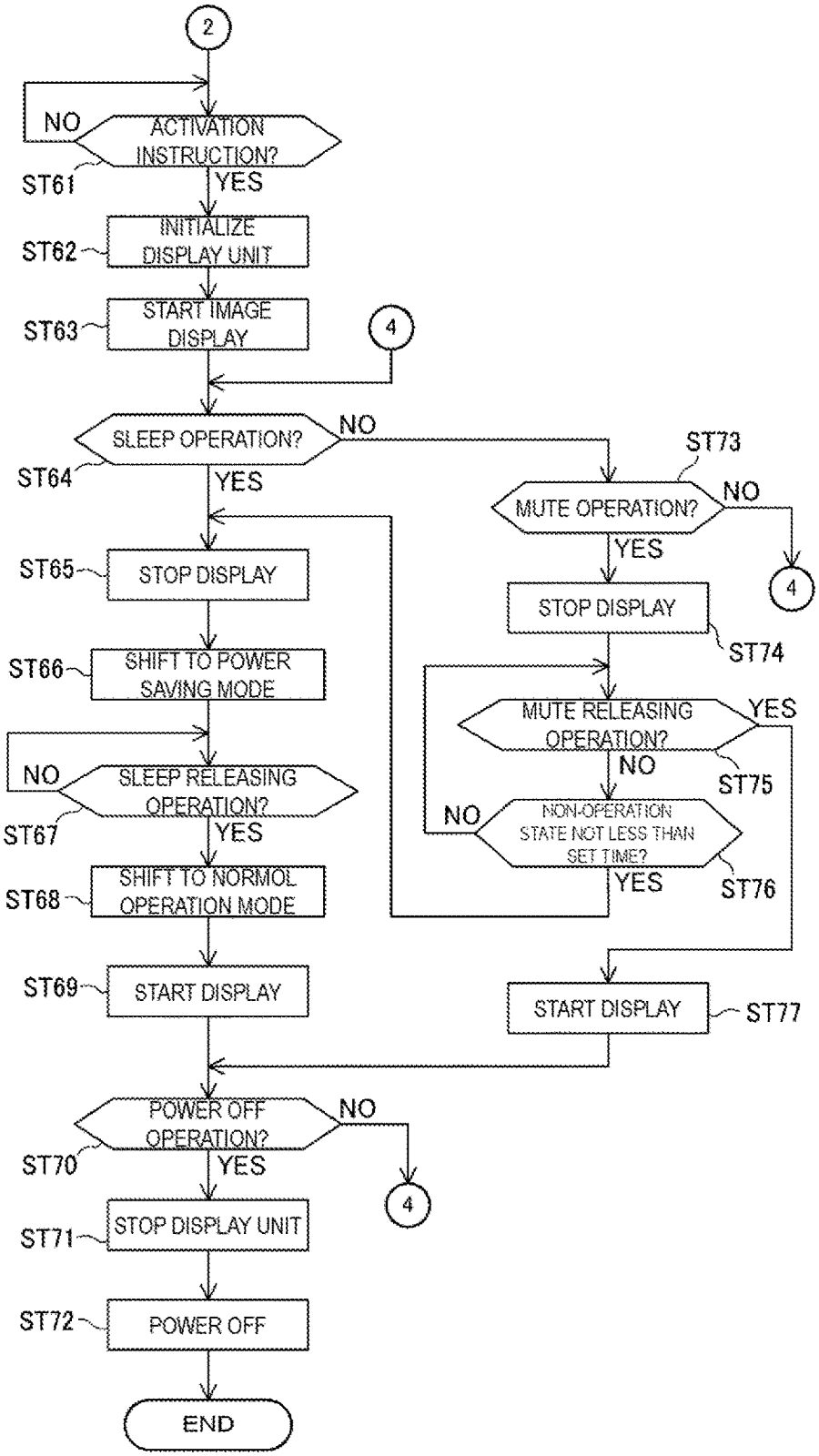
FIG. 7 is a flowchart illustrating operations of the HMD.

FIGS. 5, 6, and 7 are flowcharts illustrating operations of the HMD 100.

In the operations illustrated in FIGS. 5, 6, and 7, at least one of the PC 300, the image output device 400, and the power supply device 500 is connected to the HMD 100, and image data and power are supplied to the I/F unit 110.

The control unit 120 of the HMD 100 switches on the power of the HMD 100 and starts the activation control (step ST11) by detecting the operation to turn on the power of the HMD 100 or the start of power supply to the I/F unit 110.

The control unit 120 executes power supply control and starts the power supply to each component provided in the connection device 10 (step ST12). The control unit 120 detects the connection status of the connector 11A and the connectors 11B, 11C, and 11D of the I/F unit 110 by the connection detector 152 (step ST13). Although not illustrated, in a case where the image display unit 20 is not connected, the control unit 120 waits until the image display unit 20 is connected. Further, in a case where no external device other than the device for supplying power is connected to the I/F unit 110, the control unit 120 may wait until the external device is connected.

The control unit 120 acquires the display condition data 133 stored in the non-volatile storage unit 130 (step ST14) and determines the display mode designated by the display condition data 133 (step ST15).

In step ST15, in a case where the display mode is determined to be the first display mode (ST15; first display mode), the control unit 120 executes activation control in the first display mode. That is, the control unit 120 initializes the image display unit 20 (step ST16) and sets the sleep function and the operation of power off to be disabled (step ST17). Further, the control unit 120 sets the mute function to be disabled. After this, the control unit 120 causes the image display unit 20 to start displaying the image based on the image data received by the display control unit 124 (step ST19) and ends the activation control. In a case where a plurality of external devices that supply image data are connected to the I/F unit 110, the control unit 120 may select an external device designated by the setting data 132 as an image source in step ST19.

After the display of the image is started in step ST19, the control unit 120 set the operation of turning off the power to be disabled. Therefore, it is necessary to remove the external device that supplies power to the HMD 100 to turn off the power supply of the HMD 100.

In step ST15, in a case where the display mode is determined to be the second display mode (step ST15; second display mode), the control unit 120 executes activation control in the second display mode. That is, the control unit 120 initializes the image display unit 20 (step ST13) and causes the image display unit 20 to start displaying the image based on the image data received by the display control unit 124 (step ST32). In step ST32, in the case where the plurality of external devices that supply image data are connected to the I/F unit 110, the control unit 120 may select the external device designated by the setting data 132 as the image source.

The control unit 120 determines whether there is an operation for instructing the execution of the sleep function (step ST33). In step ST33, in a case where there is an operation for instructing the execution of the sleep function (step ST33; YES), the control unit 120 causes the right display unit 22 and the left display unit 24 to stop displaying (step ST34) and shifts to the power saving mode (step ST35). Further, in step ST33, in a case where the operation state of the HMD 100 satisfies the execution condition of the sleep function, the control unit 120 may determine that there is an operation for instructing the execution of the sleep function.

The control unit 120 determines whether there is an operation of releasing the sleep function, that is, an operation for instructing to return from the power saving mode to the normal operation mode (step ST36), and the control unit 120 waits while there is no corresponding operation (ST36; NO). In a case where there is an operation of releasing the sleep function (step ST36; YES), the control unit 120 returns to the normal operation mode (step ST37). That is, the control unit 120 shifts from the power saving mode to the normal operation mode and causes the right display unit 22 and the left display unit 24 to start displaying the image (step ST38).

The control unit 120 determines whether there is an operation of turning off the power of the HMD 100 (step ST39). In a case where there is no operation of turning off the power of the HMD 100 (step ST39; NO), the control unit 120 returns to step ST33. In addition, in a case where there is an operation of turning off the power (step ST39; YES), the control unit 120 executes control of stopping the operation of the image display unit 20 (step ST40) and subsequently turns off the power supply of the connection device 10 (step ST41).

Further, in a case where there is an operation for instructing the execution of the sleep function (step ST33; NO), the control unit 120 determines whether there is an operation for instructing the mute function (step ST42). In a case where there is no operation for instructing the mute function (step ST42; NO), the control unit 120 returns to step ST33.

In a case where the operation for instructing the mute function has been made (step ST42; YES), the control unit 120 causes the right display unit 22 and the left display unit 24 to stop displaying (step ST43).

The control unit 120 determines whether there is an operation of releasing the mute function (step ST44). The control unit 120 determines whether there is an operation of releasing the mute function (step ST44). In a case where no corresponding operation (step ST44; NO), the control unit 120 determines whether a non-operation state in which the operating unit 140 does not detect the operation continues for a time not less than a set time (step ST45). In a case where a state in which the connection device 10 is operated continues for a time not less than the set time during the execution of the mute function, the control unit 120 shifts to the power saving mode. The set time is designated by, for example, information included in the setting data 132. In a case where the non-operation state continues for a time not less than the set time (step ST45; YES), the control unit 120 proceeds to step ST34 and shifts to the power saving mode.

In a case where the non-operation state has not reached the set time (step ST45; NO), the control unit 120 returns to step ST44 and waits for an operation of releasing the mute function.

Further, in a case where there is an operation of releasing the mute function (YES in step ST44), the control unit 120 causes the right display unit 22 and the left display unit 24 to start displaying (step ST46) and proceeds to step ST39.

In step ST15, in a case where the display mode is determined to be the third display mode (step ST15; third display mode), the control unit 120 execute activation control in the third display mode. That is, the control unit 120 waits until there is an operation for instructing activation by the operating unit 140 (step ST61). The control unit 120 determines whether there is an operation instructing activation (step ST61) and continues a waiting state in a case where there is no operation (step ST61; NO). In addition, in a case where there is an operation, the control unit 120 initializes the image display unit 20 (step ST62) and causes the image display unit 20 to start displaying the image based on the image data received by the display control unit 124 (step ST63). In step ST63, in the case where the plurality of external devices that supply image data are connected to the I/F unit 110, the control unit 120 may select the external device designated by the setting data 132 as the image source. The operations of steps ST63 to ST72 are the same as the steps ST32 to ST41 in the second display mode described with reference to FIG. 6.

That is, the control unit 120 determines whether there is an operation for instructing the execution of the sleep function (step ST63). In a case where there is an operation for instructing the execution of the sleep function (step ST64; YES), the control unit 120 causes the right display unit 22 and the left display unit 24 to stop displaying (step ST65), and the control unit 120 shifts to the power saving mode (step ST66).

The control unit 120 determines whether there is an operation of releasing the sleep function (step ST67) and waits while there is no corresponding operation (step ST67). In a case where the operation of releasing the sleep function has been made (step ST67; YES), the control unit 120 returns to the normal operation mode (step ST68). The control unit 120 shifts from the power saving mode to the normal operation mode and causes the right display unit 22 and the left display unit 24 to start displaying the image (step ST69).

The control unit 120 determines whether there is an operation of turning off the power of the HMD 100 (step ST70). In a case where there is no operation of turning off the power (step ST70; NO), the control unit 120 returns to step ST64. In a case where the operation of turning off the power has been made (step ST70; YES), the control unit 120 executes control of stopping the operation of the image display unit 20 (step ST71) and subsequently turns off the power of the connection device 10 (step ST72).

In a case where there is no operation for instructing the execution of the sleep function (step ST64; NO), the control unit 120 determines whether there is an operation for instructing the mute function (step ST73). In a case where there is no operation for instructing the mute function (step ST73; NO), the control unit 120 returns to step ST64.

In a case where the operation for instructing the mute function has been made (step ST73; YES), the control unit 120 causes the right display unit 22 and the left display unit 24 to stop displaying (step ST74).

The control unit 120 determines whether there is an operation of releasing the mute function (step ST75). In a case where there is no corresponding operation (step ST75; NO), the control unit 120 determines whether the non-operation state continues for a time not less than the set time (step ST76). In a case where the non-operation state continues for a time not less than the set time (step ST76; YES), the control unit 120 proceeds to step ST65 and shifts to the power saving mode.

In a case where the non-operation state has not reached the set time (step ST76; NO), the control unit 120 returns to step ST75 and waits for an operation of releasing the mute function.

In a case where the operation of releasing the mute function has been made (step ST75; YES), the control unit 120 causes the right display unit 22 and the left display unit 24 to start displaying the image (step ST77) and proceeds to step ST70.

Figure 8:
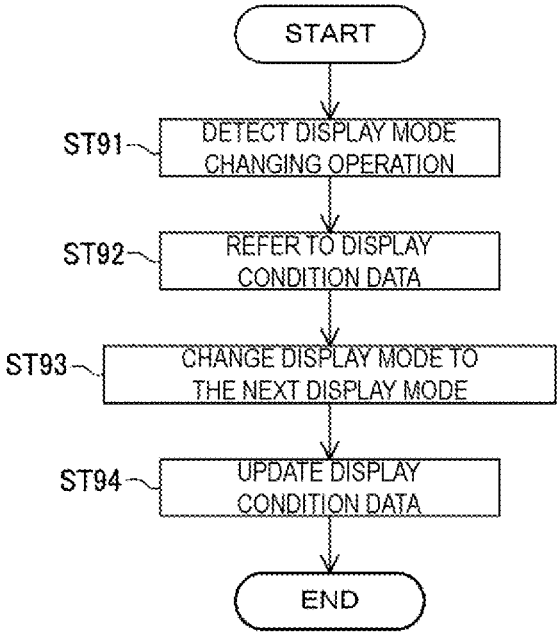
FIG. 8 is a flowchart illustrating operations of the HMD.

FIG. 8 is a flowchart illustrating the operation of the HMD 100, and FIG. 8 illustrates an operation of changing the setting regarding the display mode of the activation control executed by the HMD 100.

When the operating unit 140 detects an operation instructing to change the setting of the display mode (step ST91), the control unit 120 refers to the display condition data 133 stored in the non-volatile storage unit 130 (step ST92). The control unit 120 changes the display mode designated by the display condition data 133 to the next display mode (step ST93), and the control unit 120 updates the display condition data 133 according to the display mode after change (step ST94).

In the HMD 100, the display mode executed by the control unit 120 under the activation control can be switched in order of the first display mode, the second display mode, and the third display mode. It may be configured to be cyclically switched by switching to the first display mode after the third display mode.

The operation detected in step ST91 is a special operation which the user normally does not perform, for example, an operation of simultaneously pressing the power button 12 and the brightness adjusting button 14. For example, it is preferable to be different from an operation regarding the display function of the HMD 100 and other ordinary functions that are performed by the user.

The operation of FIG. 8 can be executed at any time while the HMD 100 is in operation, regardless of whether the activation control is in the first display mode, the second display mode, or the third display mode. In a case where the operating unit 140 detects the operation for switching the display mode, the operation in FIG. 8 is executed by the control unit 120 as an interrupt control (step ST91).

As described above, in the First Exemplary Embodiment to which the present disclosure is applied, the connection device 10 is a device to which the head-mounted image display unit 20 that includes the right display unit 22 and the left display unit 24; and the PC 300 and the image output device 400 as external devices are connected. The connection device 10 includes the control unit 120. The control unit 120 is configured to control the right display unit 22 and the left display unit 24 so as to be capable of executing functions including a display function of displaying the image input from an external device on the right display unit 22 and the left display unit; and a display stop function of stopping the display of the right display unit 22 and the left display unit 24. Here, the display stop function may include the mute function, the sleep function, and an end sequence in a case where power off is instructed. The connection device 10 includes the non-volatile storage unit 130 configured to store the display condition of the right display unit 22 and the left display unit 24. The display condition is, for example, the display condition data 133. When the power supply to the connection device 10 is started, the control unit 120 activates the image display unit 20 in the display mode based on the display condition data 133. The display mode executed by the connection device 10 includes at least a first display mode in which the image input from the external device is displayed on the right display unit 22 and the left display unit 24 by the display function and the display stop function is disabled.

Further, in the First Exemplary Embodiment to which the present disclosure is applied, the HMD 100 is a display device includes the head-mounted image display unit 20 that displays the image, and the connection device 10 connected to an external device.

According to the connection device 10 to which the connection device and the control method for the connection device of the present disclosure are applied, the image display unit 20 can be activated in a state in which the image is being displayed, with the mute function and the sleep function is disabled. In this state, even when the user operates the connection device 10, the display of the image on the image display unit 20 is not stopped. Therefore, in a case where the user is not familiar with the operation of the HMD 100, even if the user operates the connection device 10 by mistake, the viewing of the image can be maintained.

For example, in a case where a user wearing and using the image display unit 20 is different from the owner of the HMD 100, it is useful to activate the HMD 100 in the first display mode when the user visually recognizes the image on the image display unit 20. Specifically, it is assumed that, in a case where the HMD 100 is lent to the user for guiding tour information and the user is allowed to view the image of the HMD 100, the user is not familiar with the operation method of the HMD 100. In case of tour guiding, a case is assumed that one or a plurality of guiders guide a user in an art gallery, a museum, a historical site, or other sightseeing spots. In addition, the same can be applied to a case of using the HMD 100 for educational purpose. In these cases where a user is not familiar with the operation of the HMD 100, the user is prevented from stopping the image display of the HMD 100 or turning off the power of the HMD 100 by mistake, thus viewing the image as the original purpose can be continued.

Additionally, the HMD 100 to which the display device, the connection device control method, and the display device control method of the present disclosure are applied can obtain the above effects by the function of the connection device 10.

Further, the connection device 10 includes the operating unit 140 configured to receive an operation. The control unit 120 is capable of executing a display stop function based on the operation received by the operating unit 140. While the first display mode is being executed, the display stop function is not executed regardless of the operation of the operating unit 140. Therefore, the function setting of the HMD 100 and various functions can be executed by the user or by a person other than the user. In addition, for example, in a case where a user who is not familiar with the operation of the HMD 100 is using the HMD 100, stopping the image display due to an erroneous operation can be prevented, by activating in the first display mode.

The display mode executed by the connection device 10 includes a second display mode in which the control unit 120 executes the display function to display the image input from the external device on the right display unit 22 and the left display unit 24, and the control unit 120 executes the display stop function according to the operation of the operating unit 140. By causing the connection device 10 to execute the second display mode, the HMD 100 can operate in a state where the mute function, the sleep function, and the like are enabled. Therefore, the display can be prevented from being stopped due to an erroneous operation without impairing the convenience in a case where a user who is skilled in the operation of the HMD 100 is using the HMD 100.

The display mode executed by the connection device 10 includes a third display mode in which the control unit 120 does not cause the image to be displayed on the right display unit 22 and the left display unit 24 but executes the display function according to the operation of the operating unit 140. By causing the connection device 10 to execute the third display mode, the HMD 100 can be activated in a state where no image is displayed until the connection device 10 is operated. Further, in the third display mode, the HMD 100 can be operated in a state where the mute function, the sleep function, and the like are enabled. Therefore, the display can be prevented from being stopped due to an erroneous operation without impairing the convenience in a case where a user who is skilled in the operation of the HMD 100 is using the HMD 100.

Furthermore, the connection device 10 is capable of changing the display mode executed when the power of the HMD 100 is turned on by operating the operating unit 140. Further, in a case where the display mode is changed, the display condition data 133 can be updated. Therefore, the execution of the display stop function can be restricted, the HMD 100 can operate in a state where the display stop function is enabled, and these display modes can be easily switched. Thus, the display can be prevented from being stopped due to an erroneous operation without impairing the convenience in a case where a user who is skilled in the operation of the HMD 100 is using the HMD 100.

The connection device 10 includes the connector 11A as a first connection unit connected to the image display unit 20. The connection device 10 further includes the connector 11B and the connector 11D as the second connection unit configured to receive power supply. The connection device 10 further includes the connector 11B and the connector 11C as the third connection unit connected to the external device to receive input of image. When the power supply to the second connection unit is started, the control unit 120 activates the image display unit 20 in the display mode based on the display condition stored in the non-volatile storage unit 130.

In addition, the second connection unit may be formed integrally with the third connection unit and may be configured to receive power supply from the external device. Specifically, the connector 11B functions as the second connection unit that receives the power supply and the third connection unit which is connected to the external device and receives the input of image.

2. Second Exemplary Embodiment

Figure 9:
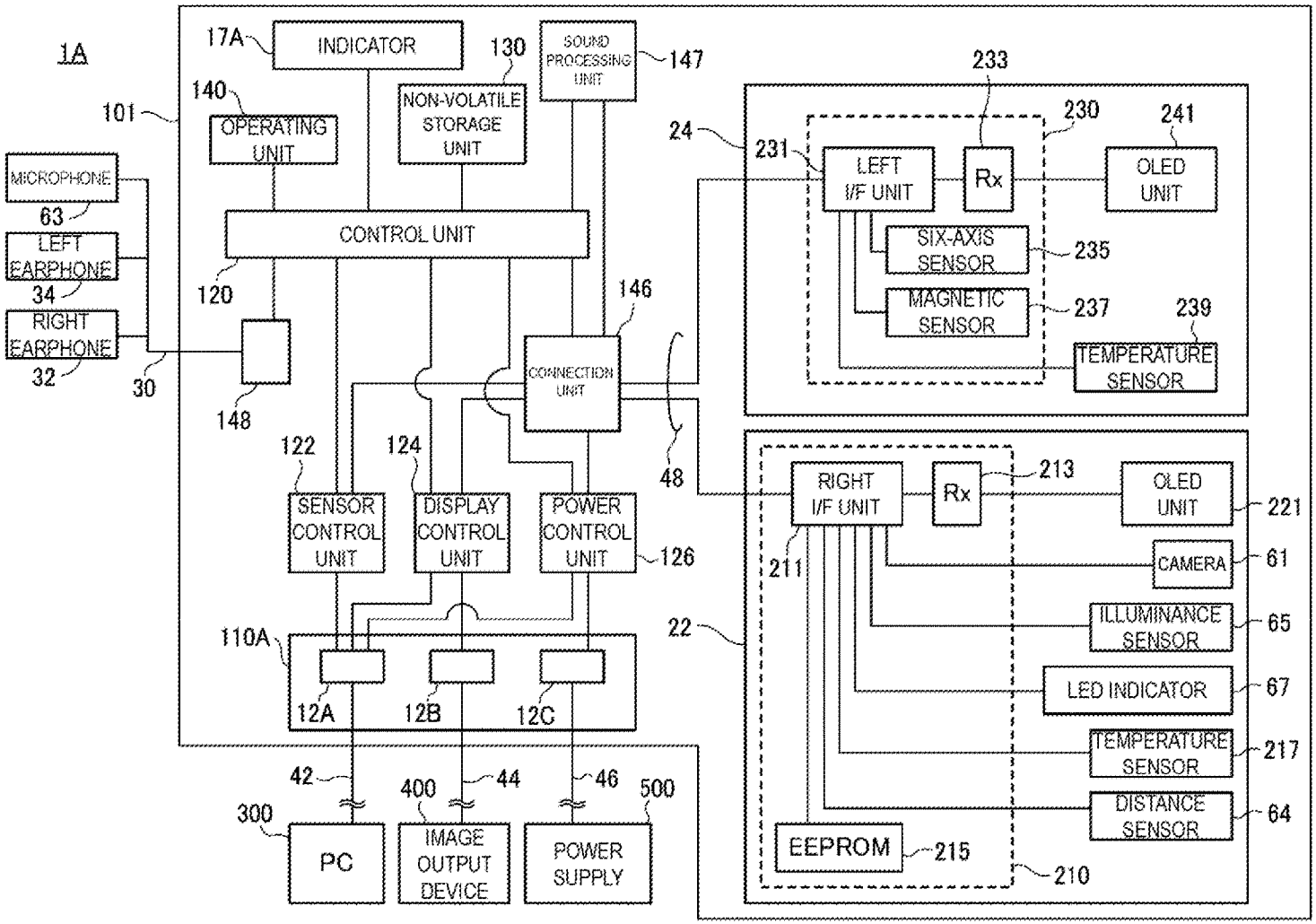
FIG. 9 is a block diagram of a display system according to Second Exemplary Embodiment.

FIG. 9 is a block diagram of a display system 1A according to the Second Exemplary Embodiment to which the present disclosure is applied, illustrating the configuration of an HMD 101 in detail.

The HMD 101 is a device in which functional units of the connection device 10 of FIG. 2 are integrally configured in the image display unit 20 of FIG. 2. That is, the right display unit 22 and the left display unit 24 are accommodated in the housing of the image display unit 20 illustrated in FIG. 1, together with the functional units corresponding to the connection device 10. The HMD 101 corresponds to the display device of the present disclosure.

The HMD 101 includes the control unit 120, the sensor control unit 122, the display control unit 124, the power control unit 126, the non-volatile storage unit 130, the operating unit 140, and the sound processing unit 147. These parts are configured in the same manner as in the First Exemplary Embodiment described above.

Additionally, the HMD 101 includes an indicator 17A. The indicator 17A is configured similarly to the indicator 17 in FIG. 2 and configured to light up according to the operation state of the HMD 101. For example, the indicator 17A is installed in the right holding part 21, the left holding part 23, or the front frame 27.

The HMD 101 includes an I/F unit 110A. The I/F unit 110A includes connectors 12A, 12B, and 12C provided in the image display unit 20. Interface specifications and configurations corresponding to the connectors 12A, 12B, and 12C are similar to those of the connectors 11B, 11C, and 11D, respectively. Therefore, the PC 300, the image output device 400, and the power supply device 500 can be connected to the I/F unit 110A.

Further, the HMD 101 also includes a connection unit 146. Similarly to the connection unit 145, the connection unit 146 connects each part including the control unit 120 to the right display unit 22 and the left display unit 24. In the HMD 101, the connection unit 146 is configured integrally with the right display unit 22 and the left display unit 24; thus, a connection cable 48 inside the device is used instead of the display unit connection cable 40 (FIG. 1). The connection cable 48 connects the right I/F unit 211 and the left I/F unit 231 to each part of the control unit 120, the sensor control unit 122, the display control unit 124, and the sound processing unit 147.

Further, the HMD 101 includes a connection unit 148. The connection unit 148 includes a connector to which a headset 30, having a right earphone 32, a left earphone 34, and a microphone 63, is connected.

The HMD 101 illustrated in FIG. 9 can execute each operation illustrated in FIGS. 5 to 8 by the control unit 120.

That is, the HMD 101 of the Second Exemplary Embodiment is a device to which the display device and the control method for the display device according to the present disclosure are applied, which is also a head-mounted display device that includes the right display unit 22 and the left display unit 24 configured to display images. The HMD 101 includes the I/F unit 110A connected to an external device. The HMD 101 includes the control unit 120 which is capable of executing functions including a display function of displaying an image input from the external device on the right display unit 22 and the left display unit 24; and a display stop function of stopping the display of the right display unit 22 and the left display unit 24. The HMD 101 includes the non-volatile storage unit 130 configured to store display condition of the right display unit 22 and the left display unit 24. When the power supply to the image display unit 20 is started, the control unit 120 activates in a display mode based on the display condition stored in the non-volatile storage unit 130. The display mode executed by the control unit 120 includes at least a first display mode in which the image input from the external device is displayed on the right display unit 22 and the left display unit 24 by the display function and the display stop function is disabled.

According to this configuration, effects similar to those of the connection device 10 and the HMD 100 in the First Exemplary Embodiment can be obtained.

The appearance of the HMD 101 of the Second Exemplary Embodiment may not be the same as the image display unit 20. Further, in the HMD 101, the I/F unit 110A may be provided separately from the other constituent parts, and a specific shape is arbitrary.

3. Other Exemplary Embodiments

The disclosure is not limited to the configurations in the exemplary embodiments described above, and the disclosure can be implemented in various aspects without departing from the gist of the disclosure.

For example, in each of the exemplary embodiments described above, the image display unit 20 is configured to visually recognize the image on the right eye and the left eye of the user by the optical systems provided in the right display unit 22 and the left display unit 24. The present disclosure is not limited to this, and, for example, a configuration using a single optical member for allowing the user to view the image on both the right eye and the left eye may be adopted. Further, the HMDs 100 and 101 may be devices that allow the user to visually recognize the image only on either the right eye or the left eye of the user.

Further, in the First Exemplary Embodiment, the connector 11B is exemplified as an aspect in which the second connection unit by which the connection device 10 is supplied with power; and the third connection unit configured to receive input of an image are formed integrally. Further, in the Second Exemplary Embodiment, the connector 12A is illustrated as a similar configuration. The present disclosure is not limited to this. That is, the aspect in which the second connection unit and the third connection unit are formed integrally is not limited to the example in which one connector receives power supply and input of an image. For example, the aspect can be a connection unit connected to one cable capable of transmitting an image and supplying the power. In this case, the number of connectors to which the cable is connected may be one, or the cable described above may branch and be connected to a plurality of connectors. The cable may be a cable that combines a line for transmitting an image with a line for supplying power by a sheath, or the cable may be a cable that combines a cable for transmitting an image with a cable for supplying power and gathers them into one in appearance.

In the exemplary embodiments described above, the connection device 10 includes the connectors 11B, 11C, and 11D, and the HMD 101 includes the connectors 12A, 12B, and 12C, but the arrangement and the number of the connectors can be arbitrarily changed. The connection device 10 and the HMD 101 may include at least one connector to which an image is input as the second connection unit; and at least one connector to which power is supplied. For example, the connection device 10 may be configured to include only the connector 11B or may be configured to include only the connectors 11C and 11D. Similarly, the HMD 101 may be configured to include only the connector 12A or may be configured to include only the connectors 12B and 12C. Further, the connection device 10 may be configured to be capable of inputting not less than three image signals. For example, the connection device 10 may be configured to include not less than two or three interface circuits and connectors having the same functions as the connectors 11B and 12A. Further, the connection device 10 may be configured to include not less than two or three interface circuits and connectors having the same functions as the connectors 11C and 12B.

Furthermore, the second connection unit may be configured to transmit images wirelessly. Instead of or in addition to the connectors 11B, 11C, 12A, and 12B illustrated as an aspect of the second connection unit, the connection device 10 and the HMD 101 may include a wireless communication unit. In this case, the wireless communication unit functions as the second connection unit. In this case, the connection detector 152 detects that the connection device 10 is wirelessly connected to another device.

Additionally, the image display unit 20 may be configured as a holographic display device. In this case, the image display unit 20 can be configured to include, for example, a light source and a spatial light modulator configured to modulate light from the light source. For example, as the spatial light modulator, SLM can be adopted. Specifically, a reflective spatial light phase modulator utilizing a liquid crystal known as LCOS can be used. SLM is an abbreviation for Spatial Light Modulator, and LCOS is an abbreviation for Liquid Crystal On Silicon-SLM.

Further, in each of the exemplary embodiments described above, the configuration in which the user visually recognizes the external scene through the image display unit is not limited to a configuration in which the right display unit 22 and the left display unit 24 transmit outside light. For example, the disclosure is applicable to a display device configured to display an image in a state where an external scene cannot be visually recognized. Specifically, the present disclosure can be applied to a display device configured to display a captured image of the camera 61, an image or Computer Graphics (CG) generated based on the captured image, an image based on image data stored in advance or based on image data input from outside, or the like. This kind of display device can include a so-called closed type display device in which an external scene cannot be visually recognized. Further, as described in the exemplary embodiments described above, an AR display, in which an image superimposed on a real space is displayed in the real space, or an MR display, in which an imaged captured in a real space image and a virtual image are combined, may be used. Alternatively, the present disclosure is applicable to a display device configured not to perform processing such as VR display for displaying a virtual image. MR is an abbreviation for Mixed Reality and VR is an abbreviation for Virtual Reality. For example, a display device configured to display image data input from an outside or an analogue image signal is also, as a matter of course, encompassed as the application of the disclosure.

Additionally, instead of the image display unit 20, for example, an image display unit of another type such as an image display unit worn as a hat may be adopted, as long as the image display unit includes a display unit configured to display an image in correspondence with the left eye of the user; and a display unit configured to display an image in correspondence with the right eye of the user. Additionally, the display device in the disclosure may be configured, for example, as a head mounted display mounted on a vehicle such as a car and an airplane. Further, the display device may be configured, for example, as a head-mounted display built into a body protector tool such as a helmet. In this case, a portion located in a position with respect to a body of a user; and a portion located with respect to such a portion can serve as mounted parts.

Further, each of the functional blocks illustrated in the block diagrams of FIG. 2, FIG. 3, FIG. 4, and FIG. 9 may be configured to be implemented by hardware or may be configured to be implemented through cooperation between hardware and software, without being limited to the configuration in which separate hardware resources are disposed as illustrated in the drawings.

What is claimed is:

1. A connection device to which an information processing device and a display device that is head-mounted and that includes an image display unit are connected, the connection device comprising:

a control unit configured to control the image display unit to execute functions including (i) a display function of displaying, on the image display unit, an image input from the information processing device and (ii) a display stop function of stopping display by the image display unit, the display stop function comprising a sleep function of the display device in which power is still supplied to the display device but at an amount reduced from a normal operation mode of the display device; and a storage unit configured to store display condition of the image display unit, wherein the control unit activates the display device in a display mode based on the display condition stored in the storage unit when power supply to the connection device is started, and the display mode includes at least a first display mode in which the image input from the information processing device is displayed on the image display unit by the display function and the display stop function is disabled.

2. The connection device according to claim 1, further comprising:

an operating unit configured to receive an operation, wherein the control unit is configured to execute the display stop function based on the operation received by the operating unit and not to execute the display stop function regardless of the operation of the operating unit during execution of the first display mode.

3. The connection device according to claim 2, wherein the display mode includes a second display mode in which the control unit executes the display function to display, on the image display unit, the image input from the information processing device and executes the display stop function according to the operation of the operating unit.

4. The connection device according to claim 2, wherein the display mode includes a third display mode in which the control unit does not cause the image to be displayed on the image display unit and executes the display function according to the operation of the operating unit.

5. The connection device according to claim 1, comprising:

a first connection unit connected to the display device;

a second connection unit configured to receive power supply; and a third connection unit connected to the information processing device to receive input of an image, wherein the control unit activates the display device in a display mode based on the display condition stored in the storage unit when power supply to the second connection unit is started.

6. The connection device according to claim 5, wherein the second connection unit is formed integrally with the third connection unit and receives power supply from the information processing device.

7. A display device that is head-mounted and that includes an image display unit, the display device comprising:

a connection unit connected to an information processing device;

a control unit configured to execute functions including (i) a display function of displaying, on the image display unit, an image input from the information processing device and (ii) a display stop function of stopping display by the image display unit, the display stop function comprising a sleep function of the display device in which power is still supplied to the display device but at an amount reduced from a normal operation mode of the display device; and a storage unit configured to store a display condition of the image display unit, wherein the control unit performs activation in a display mode based on the display condition stored in the storage unit when power supply to the display device is started, and the display mode includes at least a first display mode in which the image input from the information processing device is displayed on the image display unit by the display function and the display stop function is disabled.

8. A control method for a display device that includes an image display unit that is head-mounted and that is configured to display an image, and a connection unit connected to an information processing device, the display device being configured to execute functions including (i) a display function of displaying, on the image display unit, an image input from the information processing device and (ii) a display stop function of stopping display by the image display unit, the display stop function comprising a sleep function of the display device in which power is still supplied to the display device but at an amount reduced from a normal operation mode of the display device, the control method comprising:

performing activation in a display mode based on a display condition stored in a storage unit when power supply to the display device is started, wherein the display mode includes at least a first display mode in which the image input from the information processing device is displayed on the image display unit by the display function and the display stop function is disabled.

* * * * *